US005982094A

United States Patent [19]

Niigaki et al.

[11] Patent Number: 5,982,094

[45] Date of Patent: Nov. 9, 1999

[54] ELECTRON TUBE WITH POLYCRYSTALLINE DIAMOND PHOTOCATHODE

[75] Inventors: Minoru Niigaki; Toru Hirohata; Hirofumi Kan; Masami Yamada, all of Hamamatsu, Japan

[73] Assignee: Hamamatsu Photonics K.K., Hamamatsu, Japan

[21] Appl. No.: 08/931,459

[22] Filed: Sep. 17, 1997

[30] Foreign Application Priority Data

Sep. 17, 1996 [JP] Japan ..... 8-244976

[51] Int. Cl.[6] ..... H01J 40/06

[52] U.S. Cl. ..... 313/542; 313/544; 313/539; 313/530

[58] Field of Search ..... 313/542, 543, 313/544, 539, 532, 525, 528, 530, 310, 529; 219/121 EB

[56] References Cited

U.S. PATENT DOCUMENTS

| | | | |
|---|---|---|---|
| 3,949,187 | 4/1976 | Wulf | 219/121 EB |
| 4,163,174 | 7/1979 | Johnson | 313/529 |
| 4,639,638 | 1/1987 | Purcell et al. | 313/539 |
| 5,180,951 | 1/1993 | Dworsky et al. | 315/169.3 |
| 5,381,755 | 1/1995 | Glesener et al. | 117/88 |
| 5,463,271 | 10/1995 | Geis et al. | 313/310 |
| 5,684,360 | 11/1997 | Baum et al. | 313/542 |

FOREIGN PATENT DOCUMENTS

| | | | |
|---|---|---|---|
| 0 523 494 | 1/1993 | European Pat. Off. | H01J 1/30 |
| 0 685 869 | 12/1995 | European Pat. Off. | H01J 1/30 |
| 1 602 170 | 11/1970 | France . | |
| 2 608 842 | 6/1988 | France | H01J 1/30 |
| 95/22169 | 8/1995 | WIPO | H01J 1/30 |

OTHER PUBLICATIONS

Himpsel et al, "Quantum Photoyield of Diamond (111)—A Stable Negative–Affinity Emitter", Physical Review B, vol. 20, No. 2, Jul. 15, 1979, pp. 624–627.

Eimori et al, "Photoyield Measurements of CVD Diamond", Diamond and Related Materials 4 (1995), pp. 806–808.

Eimori et al, "Electron Affinity of Single–Crystalline Chemical–Vapor–Deposited Diamond Studied by Ultraviolet Synchrotron Radiation", Jpn. J. Appl. Phys., vol. 33 (1994) pp. 6312–6315, Part 1, No. 11, Nov. 1994.

Fox et al, "Photoelectron Emission From the Cesiated Diamond (110) Surface", Mat. Res. Soc. Symp. Proc., vol. 416, 1996 Materials Research Society, pp. 449–454 (no month).

Loh et al, "Tuning the Electron Affinity of CVD Diamond With Adsorbed Caesium and Oxygen Layers", Diamond and Related Materials, vol. 6 (1997), pp. 874–878. (no month).

Geis et al, "Capacitance—Voltage Measurements on Metal–$SiO_2$–Diamond Structures Fabricated With (100)– and (111)–Oriented Substrates", IEEE Transactions On, Mar. (1991).

J. Shirafuji et al., "x–ray photoelectron spectroscopy analysis of plasma–treated surfaces of diamond films" Diamond and Related Materials, vol. 4, 1995, pp. 984–988, XP002050514 * p. 984 * (no month).

(List continued on next page.)

*Primary Examiner*—Michael Day
*Attorney, Agent, or Firm*—Pillsbury Madison & Sutro

[57] ABSTRACT

A photocathode includes a first layer of polycrystalline diamond or a material mainly composed of polycrystalline diamond. The first layer of polycrystalline diamond may be terminated with hydrogen, or oxygen, and a second layer of an alkali metal or compound of an alkali metal, may be provided on the first layer of polycrystalline diamond whose surface is terminated with hydrogen or oxygen. The photocathode can be use for both reflection and transmission electron tubes and can yield a quantum efficiency higher than that in a monocrystal diamond thin film.

10 Claims, 20 Drawing Sheets

OTHER PUBLICATIONS

P. Muggli et al., "photoemission from diamond and fullerene films for advanced accelerator applications" IEEE Transactions on Plasma Science, vol. 24, No. 2, Apr. 1996, p. 428, XP002050515 * p. 438 *.

Minoru Niigaki et al., "studies on diamond photoemitters" Diamond Films and Technology, vol. 6, No. 6, 1996, pp. 359–363, XP002050516 * p. 359 * (Oct.).

N. Eimori et al., "photoyield measurements of cvd diamond" Diamond and Related Materials, vol. 4, 1995, pp. 806–808, XP002050517 (no month).

Hong D et al., "Field Emission From P–Type Polycrystalline Diamond Films" Mar. 1, 1995, Journal of Vacuum Science and Technology: Part B, vol. 13, NR. 2, pp. 427–430 XP000508555 * pp. 427–429 *.

ELECTRON TUBE WITH POLYCRYSTALLINE DIAMOND PHOTOCATHODE

BACKGROUND OF THE INVENTION

1. Field of the Invention

The present invention relates to a photocathode applicable to detection or measurement of light having a predetermined wavelength, and an electron tube equipped with the same.

2. Related Background Art

As a material for a photocathode which is sensitive to ultraviolet rays having a wavelength not longer than 200 nm, cesium iodide (CsI), which is a semiconductor, has been well known, for example. This photocathode has a quantum efficiency of about 25%, at the maximum, for photoelectric conversion in the vacuum ultraviolet region. Since this photocathode dramatically decreases its level (quantum efficiency for photoelectric conversion) with respect to the light to be detected having a wavelength not shorter than 200 nm, it has been known as a so-called solar-blind photocathode which is insensitive to solar light.

Accordingly, such a solar-blind photocathode is often employed in a so-called electron tube (phototube equipped with a photocathode) such as photomultiplier and is used for detecting or measuring weak light in the ultraviolet region.

SUMMARY OF THE INVENTION

Having studied the conventional photocathode such as that mentioned above, the inventors have found the following problems.

Namely, in order to detect or measure the light to be detected in the ultraviolet region with a high accuracy, a photocathode having a higher quantum efficiency for photoelectric conversion (hereinafter simply referred to as quantum efficiency or Q.E.) is required. Nevertheless, in the conventional CsI photocathode, as shown in FIG. 1, the electron affinity (Ea), i.e., the value obtained when the energy at the bottom of the conduction band (CB) is subtracted from the energy at the vacuum level (VL), is positive. It means that, of photoelectrons ($e^-$) which receive light to be detected (hv) and are thereby excited from the valence band (VB), a part cannot escape into a vacuum (a container maintaining a vacuum state). Accordingly, it has inherently been impossible for the conventional photocathode to realize a higher quantum efficiency.

On the other hand, a photocathode comprising a thin film of monocrystal diamond in place of CsI has been reported. According to the report of Himpsel et al. (Physical Review, B, 20, 2 (1979), 624), in the case where natural monocrystal diamond having a face index of (111) doped with boron (B) attains a clean surface in atomic level, i.e., where its surface has a configuration of (111)–1×1, a photocathode with a negative electron affinity (NEA) is obtained. In the case of a monocrystal diamond thin film, as can be seen from the quantum efficiency shown in FIG. 3, the quantum efficiency level is about 20% at the maximum within the range where the photon energy is 5.5 to 9 eV, whereas it is relatively high, i.e., 40% to 70%, within the range of 13 to 35 eV.

Also, Eimori et. al. synthesized, by means of microwave plasma CVD, a monocrystal diamond film on a substrate of monocrystal diamond having a face index of (100) which had been synthesized at a high pressure, and then terminated its surface with hydrogen (Diamond and Related Material, 4 (1995), 806; and Jpn. J. Appl. Phys., 33 (1994), 6312). In this case, not only when the monocrystal diamond film is oriented to (111) face but also when oriented to (100) face, its electron affinity becomes negative. In the reports of Eimori et al., synchrotron radiation was used as a light source for measuring photoelectron emission, and no absolute value of quantum efficiency was reported.

In the photocathodes such as those mentioned above, monocrystal diamond which does not transmit therethrough the light to be detected is used as the main body or supporting substrate for the photocathode. Such a photocathode made of monocrystal diamond cannot easily be applied to, a transmission type photocathode in which the surface on which the light to be detected is incident differs from the surface for emitting photoelectrons.

Also, from the viewpoint of industrial use, both natural monocrystal diamond and high-pressure-synthesized monocrystal diamond substrates are very expensive and are not suitable for mass production. Further, there is no easy technique for synthesizing, in a vapor phase, a high-quality monocrystal diamond film on such an expensive monocrystal substrate. Due to such a reason, it is difficult to make a monocrystal diamond photocathode practicable.

Therefore, it is an object of the present invention to provide a photocathode which is applicable to both reflection and transmission types and can yield a quantum efficiency higher than that of the monocrystal diamond thin film, and an electron tube equipped with the same.

The photocathode according to the present invention is an electrode for emitting a photoelectron excited from a valence band to a conduction band by incident light (light to be detected) having a predetermined wavelength and can be applied to various kinds of electron tubes such as photomultiplier for detecting light having a predetermined wavelength, image intensifier tube, and the like. This photocathode encompasses a transmission type photocathode which is formed on a substrate transparent to light to be detected and emits a photoelectron from a surface opposite an entrance surface on which the light to be detected is incident; and a reflection type photocathode which is disposed on a substrate blocking light to be detected and emits a photoelectron from a surface on which the light to be detected is incident. The transmission type photocathode is placed such that its entrance surface is perpendicular to the direction of incidence of the light to be detected, whereas the reflection type photocathode is placed so as to be inclined with respect to the direction of incidence of the light to be detected.

In order to overcome the above-mentioned problems, the photocathode of the present invention comprises a first layer made of polycrystalline diamond or a material mainly composed of polycrystalline diamond.

Preferably, at least one surface of the first layer is terminated with hydrogen or oxygen so as to lower its work function and make it easier to emit photoelectrons. In particular, a photocathode whose surface is terminated with oxygen can maintain a sufficient quantum efficiency even when exposed to the air, thus being chemically stable.

The photocathode according to the present invention may further comprise a second layer made of an alkali metal or c compound thereof, which is provided on the first layer (polycrystalline diamond layer). The second layer further improves the quantum efficiency of the photocathode. In particular, when it is formed on the first layer whose surface is terminated with hydrogen or oxygen, the quantum efficiency of the photocathode is remarkably improved.

Preferably, the conduction type of the polycrystalline diamond film, as the first layer of the photocathode, is p-type. It is due to the fact that, as compared with intrinsic semiconductors and the like, the p-type film has a lower resistance level and is easier to emit photoelectrons (attains a higher quantum efficiency).

The photocathode configured as mentioned above is applicable to various kinds of electron tubes such as photomultiplier. Namely, the electron tube according to the present invention comprises, at least, an entrance faceplate which is transparent to incident light having a predetermined wavelength; the photocathode configured as mentioned above; a container (vacuum container) for accommodating the photocathode and supporting the entrance faceplate; and an anode, accommodated in the container, for directly or indirectly collecting the photoelectron emitted from the photocathode.

In the configuration mentioned above, the photocathode is applicable to a transmission type photocathode provided on and supported by the entrance faceplate. Preferred as a material for the entrance faceplate to be combined with a solar-blind photocathode is magnesium fluoride ($MgF_2$) which is at least transparent to ultraviolet light having a wavelength not longer than 200 nm.

Also, in the configuration mentioned above, the photocathode is applicable to a reflection type photocathode which is provided on a surface of a light-shielding member facing the entrance faceplate and is supported by the light-shielding member, the light-shielding member being a member blocking incident light (material which blocks, at least, ultraviolet light having a wavelength not longer than 200 nm). As a material for the light-shielding member, silicon (Si), a metal material, or the like may be used.

The electron tube according to the present invention may further comprise an electron multiplying section which is accommodated in the container and guides to the anode secondary electrons obtained while the electron multiplying section cascade-multiplies the photoelectron emitted from the photocathode.

In the electron tube according to the present invention, the anode may be a fluorescent film which emits light when receiving the photoelectron emitted from the photocathode in response to incident light, so as to form a two-dimensional electron image corresponding to a two-dimensional optical image of the incident light. In such a configuration, the two-dimensional optical image of light to be detected can be directly observed. Further, the anode may be a solid-state imaging device which receives the photoelectron emitted from the photocathode in response to incident light and outputs an electric signal corresponding to a two-dimensional optical image of the incident light.

Here, in the electron tube configured as mentioned above, hydrogen at a partial pressure within the range of $1\times10^{-6}$ to $1\times10^{-3}$ torr is enclosed within the container. In the case where hydrogen within this pressure range is enclosed within the container, the surface of the photocathode becomes chemically stable, thereby allowing the electron tube to operate more stably. Namely, the possibility of discharge being generated within the electron tube increases when the partial pressure of hydrogen is higher than $1\times10^{-3}$ torr. By contrast, below $1\times10^{-6}$ torr, it takes a very long time for hydrogen desorbed from the surface of the polycrystalline diamond thin film to be absorbed again, thus increasing the possibility of other remaining molecules within the electron tube being absorbed by the surface of the polycrystalline diamond thin film and losing the effect resulting from enclosed hydrogen.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, embodiments of the present invention will be explained. In the accompanying drawings, parts identical to each other will be referred to with marks identical to each other, without their overlapping explanations being repeated.

The photocathode according to the present invention comprises a thin film of polycrystalline diamond (polycrystalline diamond layer). Here, the photocathode according to the present invention is an electrode for emitting a photoelectron excited from a valence band to a conduction band by incident light (light to be detected) having a predetermined wavelength and can be applied to various kinds of electron tubes such as photomultiplier for detecting light having a predetermined wavelength, image intensifier tube, and the like. Also, this photocathode encompasses a transmission type photocathode which is formed on a substrate transparent to light to be detected and emits a photoelectron from a surface opposite to an entrance surface on which the light to be detected is incident; and a reflection type photocathode which is disposed on a substrate blocking light to be detected and emits a photoelectron from a surface on which the light to be detected is incident.

Since the main layer is constituted by polycrystalline diamond, this photocathode can attain a quantum efficiency higher than that of the prior art (monocrystal diamond thin film). Namely, in a conventional photocathode, photoelectrons excited by incident light to be detected diffuse in all the directions. Then, while being repeatedly scattered within the photocathode, only the photoelectrons that have finally reached the surface of the photocathode are emitted into a vacuum (the inside of a vacuum container in which the photocathode is placed).

Figure 5:
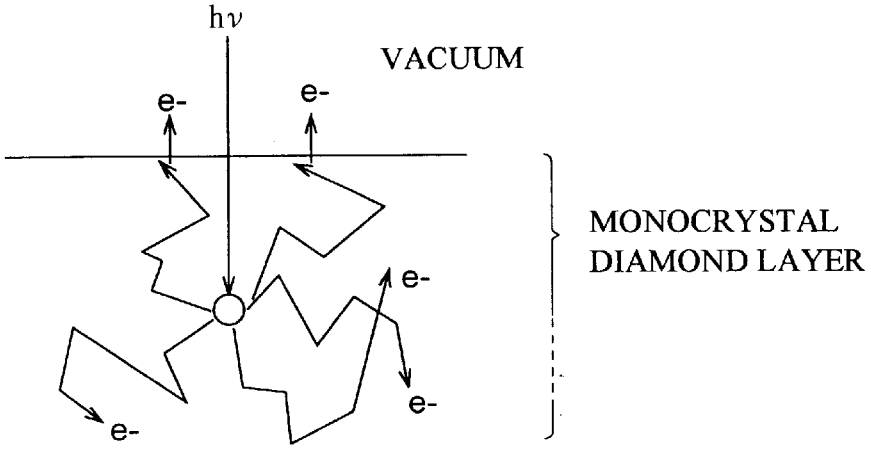
FIG. 5 is a view for explaining a behavior, within a monocrystal diamond layer, of photoelectrons generated in this layer.

In the case of a monocrystal diamond photocathode, as shown in FIG. 5, the transit length of photoelectrons from the excited position to the emitting surface position is long in general. It is due to the fact that, of the excited photoelectrons, those diffused horizontally with respect to the surface or into the opposite side thereof have a remarkably long transit length to the surface, whereby the number of photoelectrons emitted from the surface of the photocathode decreases, and the quantum efficiency is lowered.

Figure 6:
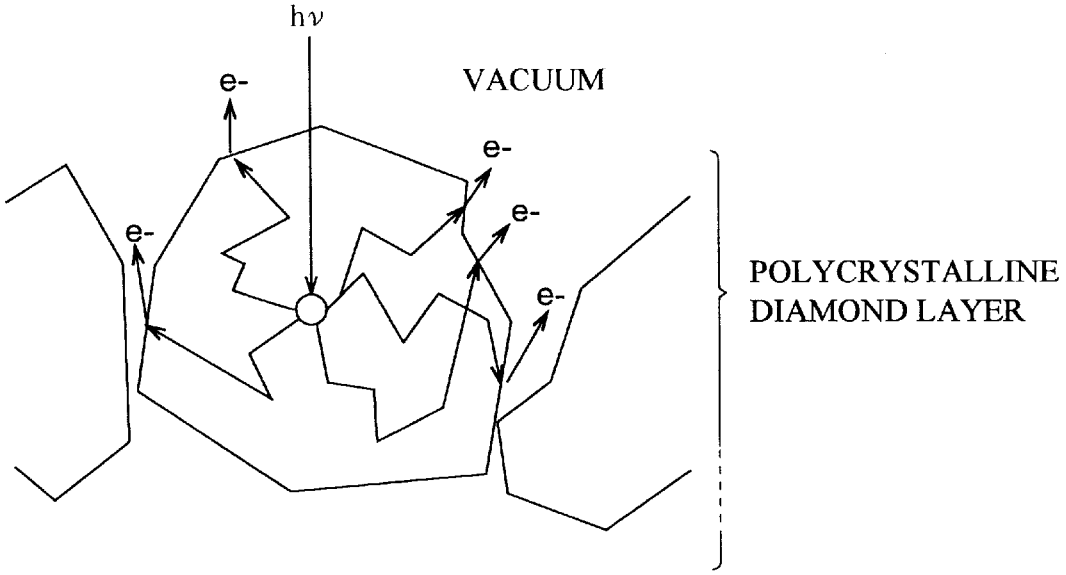
FIG. 6 is a view for explaining a behavior, within a polycrystalline diamond layer, of photoelectrons generated in this layer.

In the case of a polycrystalline diamond photocathode, by contrast, as shown in FIG. 6, there are boundaries of individual crystal grains, which become emitting surfaces for excited photoelectrons, in the respective diffusing directions of photoelectrons, whereby the transit length from the excited position to the crystal boundary (surface from which the photoelectrons are emitted) becomes shorter than that in the case of monocrystal diamond. Consequently, the number of emitted photoelectrons becomes greater than that in the case of the monocrystal diamond photocathode, thus attaining a higher quantum efficiency.

Figure 7:
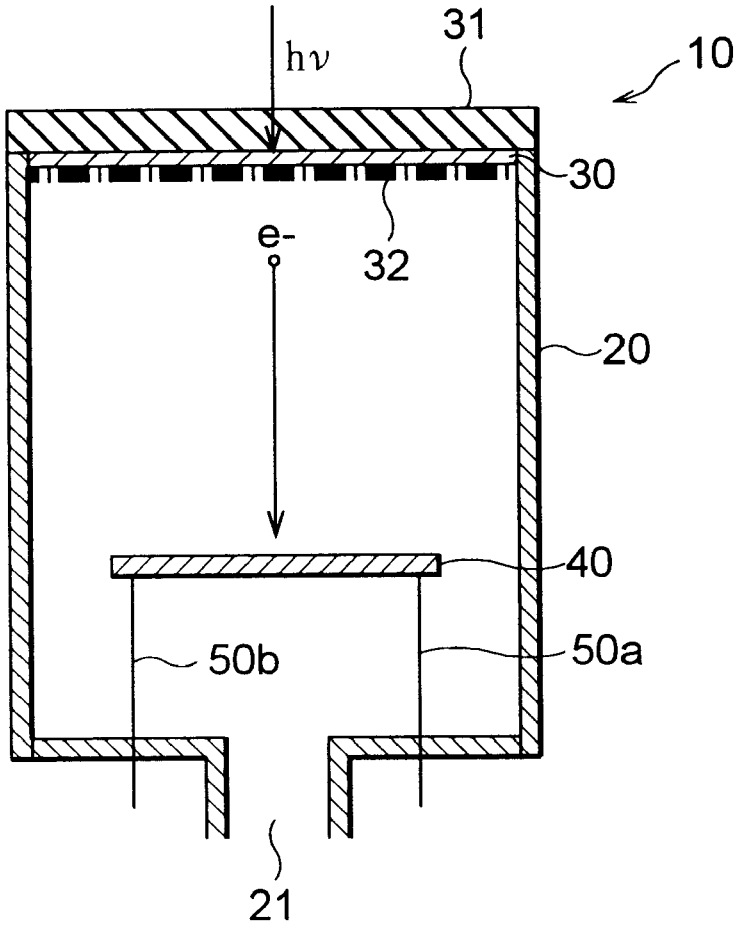
FIG. 7 is a sectional view showing a schematic configuration of an electron tube equipped with a transmission type photocathode according to the present invention.

In the following, a first example of a transmission type photocathode according to the present invention will be explained. FIG. 7 is a sectional view showing a configuration of an electron tube 10 to which the first example of the transmission type photocathode according to the present invention (a polycrystalline diamond thin film whose surface is terminated with hydrogen: H/Diamond) is applied.

This electron tube 10 detects light to be detected, which is ultraviolet light having a wavelength not longer than 200 nm. In the electron tube 10, an entrance faceplate 31 provided with a transmission type photocathode 30 is firmly supported by an end of a housing, and the other end of the housing is hermetically sealed with glass, thus constituting a vacuum container 20. Disposed within the vacuum container 20 so as to face the transmission type photocathode 30 is an anode 40 to which a positive voltage is applied with respect to the transmission type photocathode 30. Extending from the lower surface of the anode 40 are lead pins 50*a* and 50*b* each electrically connected thereto at one end.

In this example, since the light to be detected is ultraviolet light having a wavelength not longer than 200 nm, borosilicate glass, which has conventionally been in wide use, cannot be employed. It is due to the fact that borosilicate glass becomes opaque to light having a wavelength of about 300 nm or shorter. Accordingly, magnesium fluoride ($MgF_2$) or lithium fluoride (LiF) may be used for the entrance faceplate 31 for such light to be detected. Nevertheless, LiF is deliquescent and may be problematic in terms of chemical stability (likely to deteriorate its characteristics), thus making $MgF_2$ preferable at Unlike the conventional monocrystal diamond thin film, the transmission type photocathode 30 is a polycrystalline diamond thin film having a thickness of about 0.5 $\mu$m. Also, unlike the conventional CsI photocathode, the polycrystalline diamond thin film, i.e., transmission type photocathode 30, is an NEA photocathode whose electron affinity, i.e., the value obtained when the energy at the bottom of the conduction band (CB) is subtracted from the energy at the vacuum level (VL), is negative. Preferably, the polycrystalline diamond thin film is doped with an impurity such as boron (B) to attain p-type conduction. It is due to the fact that, when the conduction type of the polycrystalline diamond thin film is p-type, photoelectrons easily travel to their emitting surfaces since the conduction band of the polycrystalline diamond thin film curves. More preferably, unbound carbon on the polycrystalline diamond thin film surface (photoelectron-emitting surface) is terminated with hydrogen 32, thus lowering the work function of the polycrystalline diamond thin film.

Figure 8:
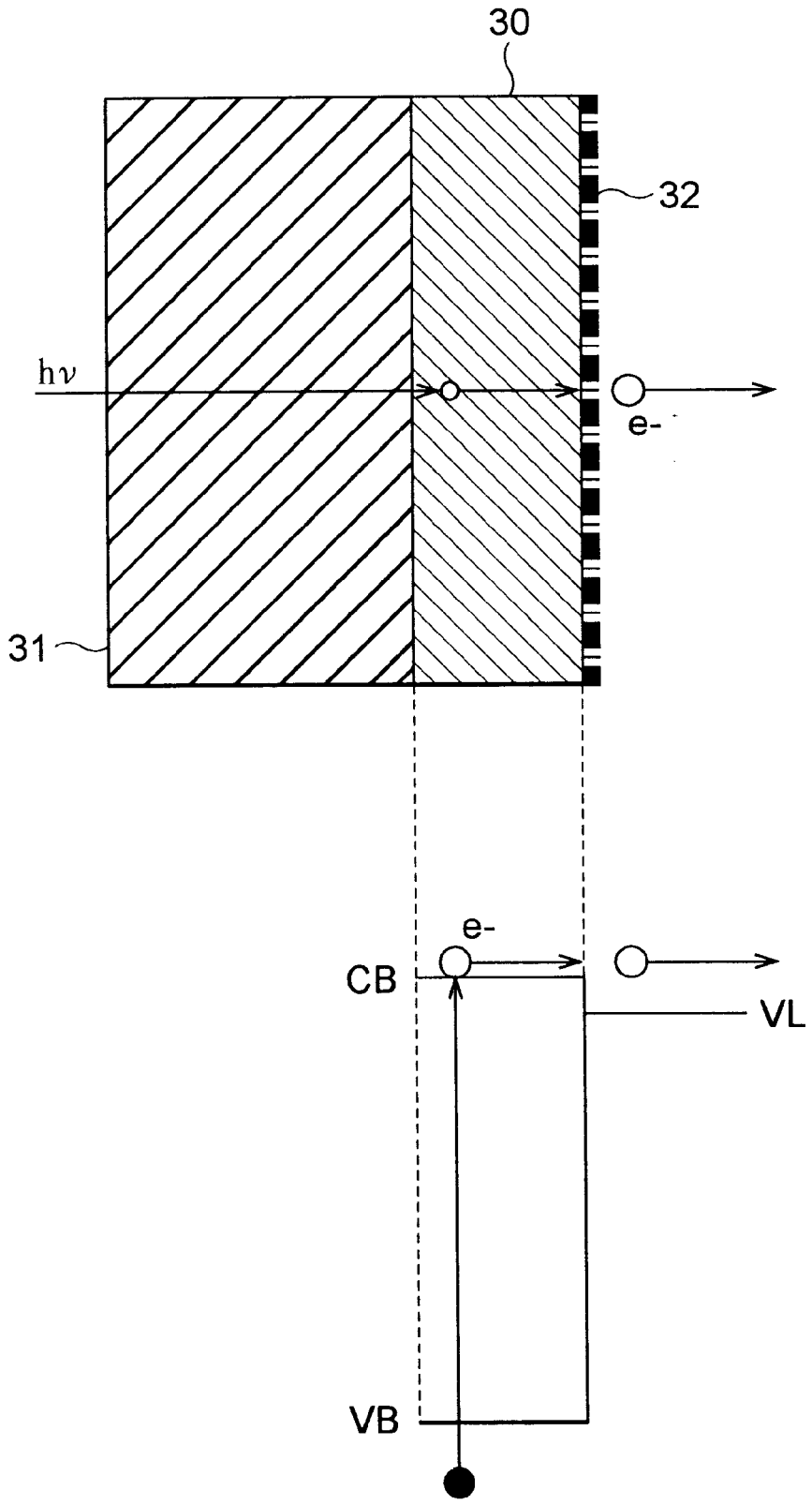
FIG. 8 is a sectional view of the transmission type photocathode according to the present invention shown in FIG. 7 and its corresponding energy band diagram.

When light to be detected (hv) is incident on the entrance faceplate 31 in the electron tube 10 equipped with such transmission type photocathode 30 (H/Diamond) as shown in FIGS. 7 and 8, a light component having a wavelength not longer than a predetermined wavelength (light component in the absorption band of the entrance faceplate 31) is absorbed by the entrance faceplate 31. Further, when the light to be detected passing through the entrance faceplate 31 reaches the transmission type photocathode 30 and is absorbed thereby, an electron-hole pair is formed, and then a photoelectron ($e^-$) is generated. Due to dispersion or an internal electric field formed within the polycrystalline diamond thin film, thus generated photoelectron reaches the surface of the diamond thin film having a negative electron affinity. Accordingly, the photoelectron is easily emitted from the polycrystalline diamond thin film. Also, in the case where the polycrystalline diamond thin film surface is terminated with hydrogen 32, its work function is lowered as compared with that without hydrogen termination, whereby the photoelectron is more easily emitted into a vacuum (outside the photocathode 30 but inside the vacuum container 20). Thus emitted photoelectron is collected at the anode 40 to which a positive voltage is applied with respect to the transmission type photocathode 30, and is taken out as an electric signal from the vacuum container 20 through the lead pins 50*a* and 50*b*.

Figure 9:
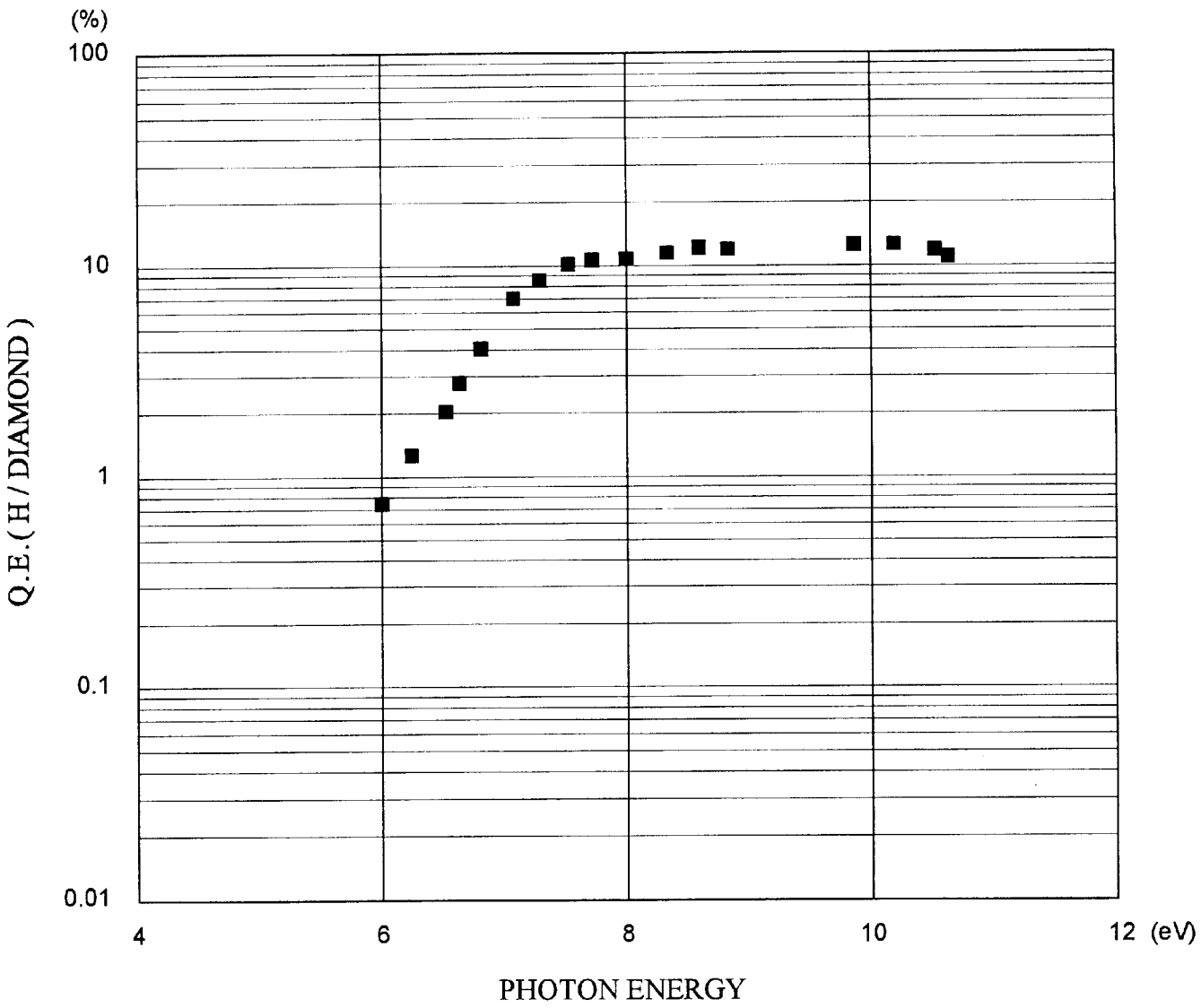
FIG. 9 is a (first) graph showing a spectral sensitivity characteristic of an electron tube equipped with a first example (H/Diamond) of the transmission type photocathode according to the present invention, whose abscissa and ordinate respectively indicate photon energy (eV) and measured quantum efficiency Q.E. (%)

The inventors measured spectral sensitivity characteristics of the electron tube 10 equipped with such transmission type photocathode 30. FIG. 9 is a graph showing a spectral sensitivity characteristic of an electron tube equipped with the first example (diamond thin film whose surface is terminated with hydrogen; hereinafter referred to as H/Diamond) of the transmission type photocathode (first embodiment) according to the present invention. In this graph, abscissa and ordinate respectively indicate photon energy (eV) and actually-measured quantum efficiency Q.E. (%)

Figure 10:
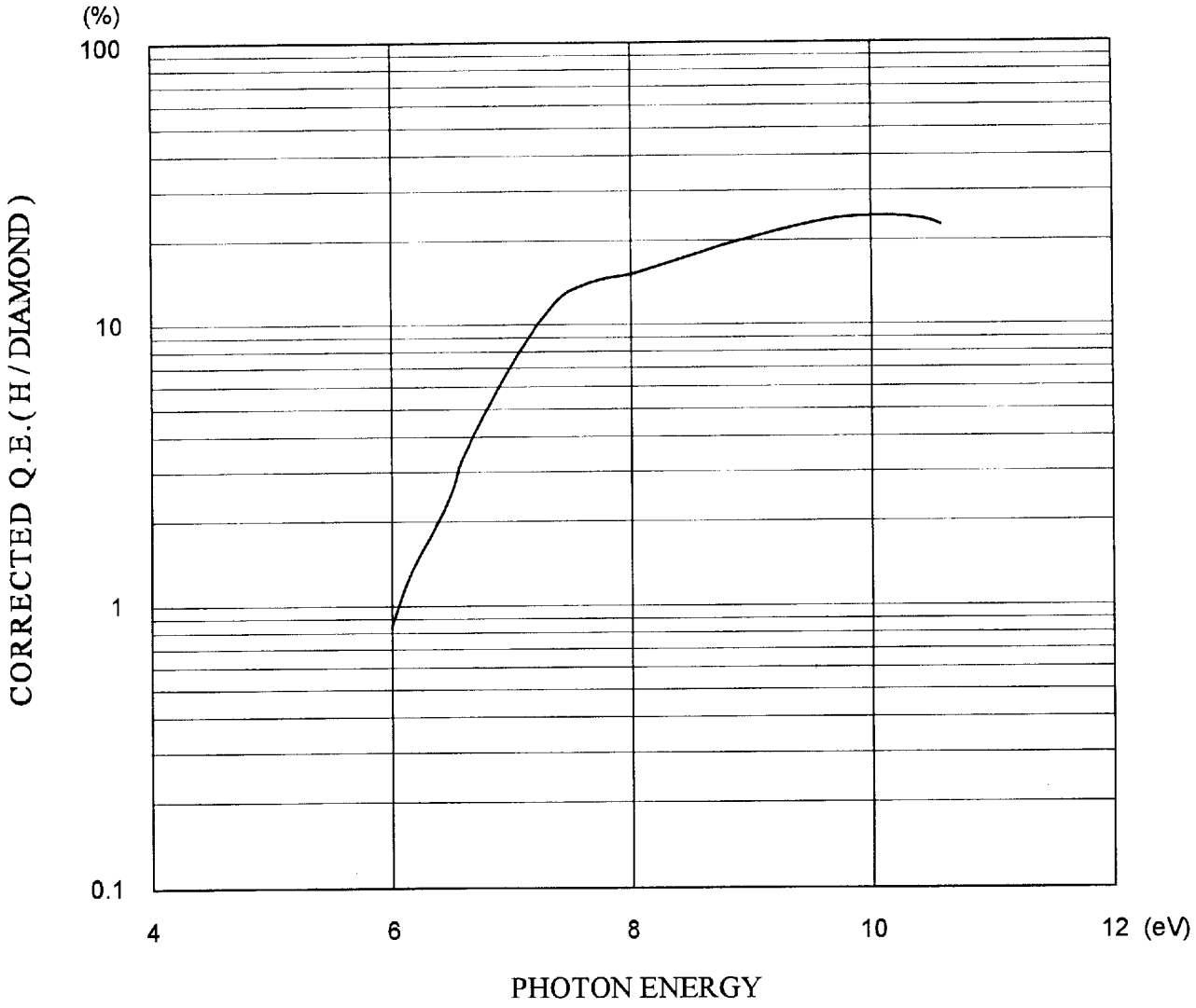
FIG. 10 is a (second) graph showing a spectral sensitivity characteristic of the electron tube equipped with the first example (H/Diamond) of the transmission type photocathode according to the present invention, whose abscissa and ordinate respectively indicate the photon energy (eV) and the quantum efficiency Q.E. (%) of the photocathode itself corrected on the basis of the transmittance of its entrance faceplate with respect to light to be detected.

As shown in this graph, in the polycrystalline diamond thin film whose surface is terminated with hydrogen (H/Diamond), a relatively high level of quantum efficiency Q.E., i.e., 12% or greater, is obtained with a good reproducibility. FIG. 10 is a graph whose ordinate indicates the quantum efficiency Q.E. (%) of the polycrystalline diamond thin film corrected on the basis of the transmittance of the entrance faceplate 31 with respect to light to be detected in the graph concerning the first example of polycrystalline diamond thin film (H/Diamond) shown in FIG. 9. As can be seen from FIG. 10, the quantum efficiency Q.E. of the H/Diamond photocathode (hydrogen-terminated polycrystalline diamond thin film) itself is about 24%. Also, the inventors have found that the quantum efficiency of a p-type polycrystalline diamond thin film (H/p-Diamond) is about twice that of an undoped polycrystalline diamond thin film. Here, even when the transmission type photocathode 30 is changed to a so-called reflection type photocathode in which light to be detected is incident on and photoelectrons are emitted from the same surface, its spectral sensitivity characteristic is essentially the same as that of the transmission type photocathode. Also, the quantum efficiency in the case where the surface of the polycrystalline diamond thin film is not terminated with hydrogen is lower than that of the hydrogen-terminated polycrystalline diamond thin film.

Such a relatively high quantum efficiency obtained in the transmission type photocathode 30 made of the polycrystalline diamond thin film is assumed to be attributable to the fact that, since the polycrystalline diamond thin film is constituted by particles each having a diameter on the order of several $\mu$m, its surface has large irregularities. Namely, light to be detected is optically refracted and scattered by these irregularities as mentioned above, thereby increasing its optical path length. Accordingly, the substantial light absorbing efficiency is raised, whereby a greater number of photoelectrons are generated. Also, since the thin film is constituted by grains, the transit length of the photoelectron emitted from each grain becomes shorter. Accordingly, it is obvious that the arrival efficiency at which the photoelectrons reach the emitting surface increases. Consequently, the photoelectrons that have reached the polycrystalline diamond thin film surface whose electron affinity is substantially zero or negative can practically escape into the vacuum (inside the vacuum container 20). Therefore, the transmission type photocathode, in which both absorption efficiency of light to be detected and surface arrival efficiency of photoelectrons are dominant, can exhibit a high quantum efficiency.

Here, it should be noted that the photocathode according to the present invention is essentially different from a field emitter.

Figure 4:
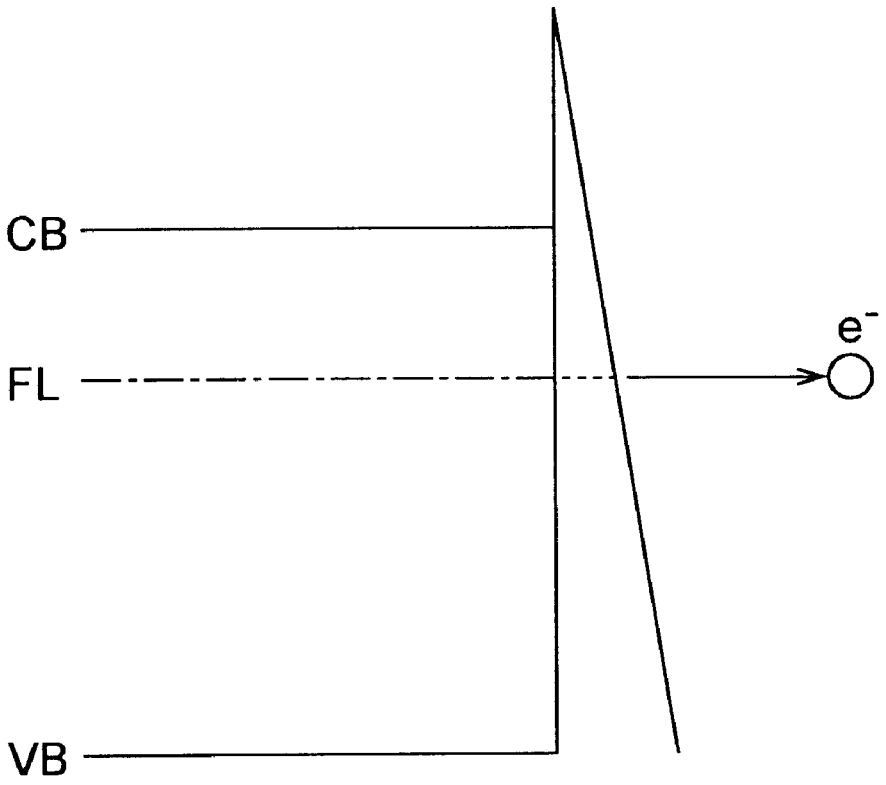
FIG. 4 is an energy band diagram for explaining a process in which an electron is emitted from a field emitter.

A device known in general as field emitter is a device which emits a Fermi-level electron into a vacuum (in a vacuum space where the field emitter is disposed) through a tunnel effect, as shown in FIG. 4, when a strong electric field ($>10^6$ V/cm) is applied to a surface of a metal or semiconductor. Namely, as can be seen from FIG. 4, the emitted electron is a Fermi-level electron and not a so-called photoelectron which is an electron excited from a valence band to a conduction band. Here, FIG. 4 is an energy band diagram for explaining a process in which an electron is emitted from the field emitter.

Figure 1:
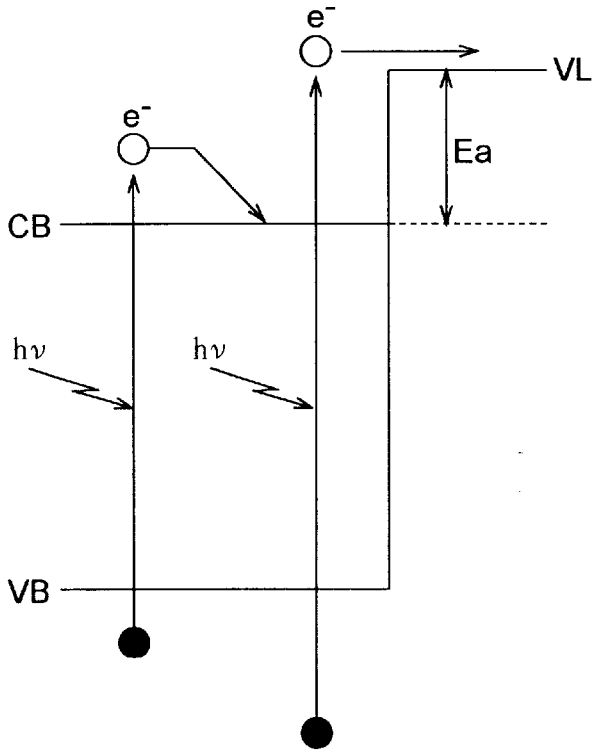
FIG. 1 is an energy band diagram for explaining a process in which photoelectrons are emitted from a CsI photocathode.
Figure 2:
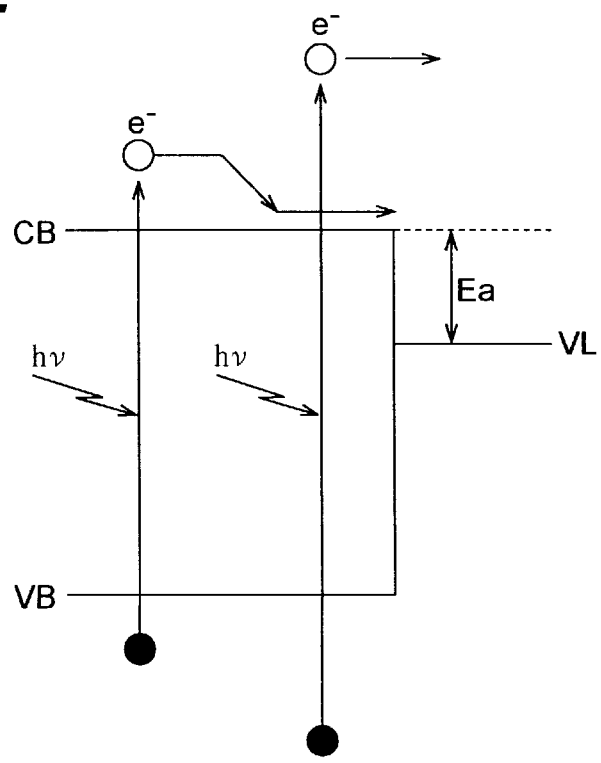
FIG. 2 is an energy band diagram for explaining a process in which photoelectrons are emitted from an NEA photocathode.
Figure 3:
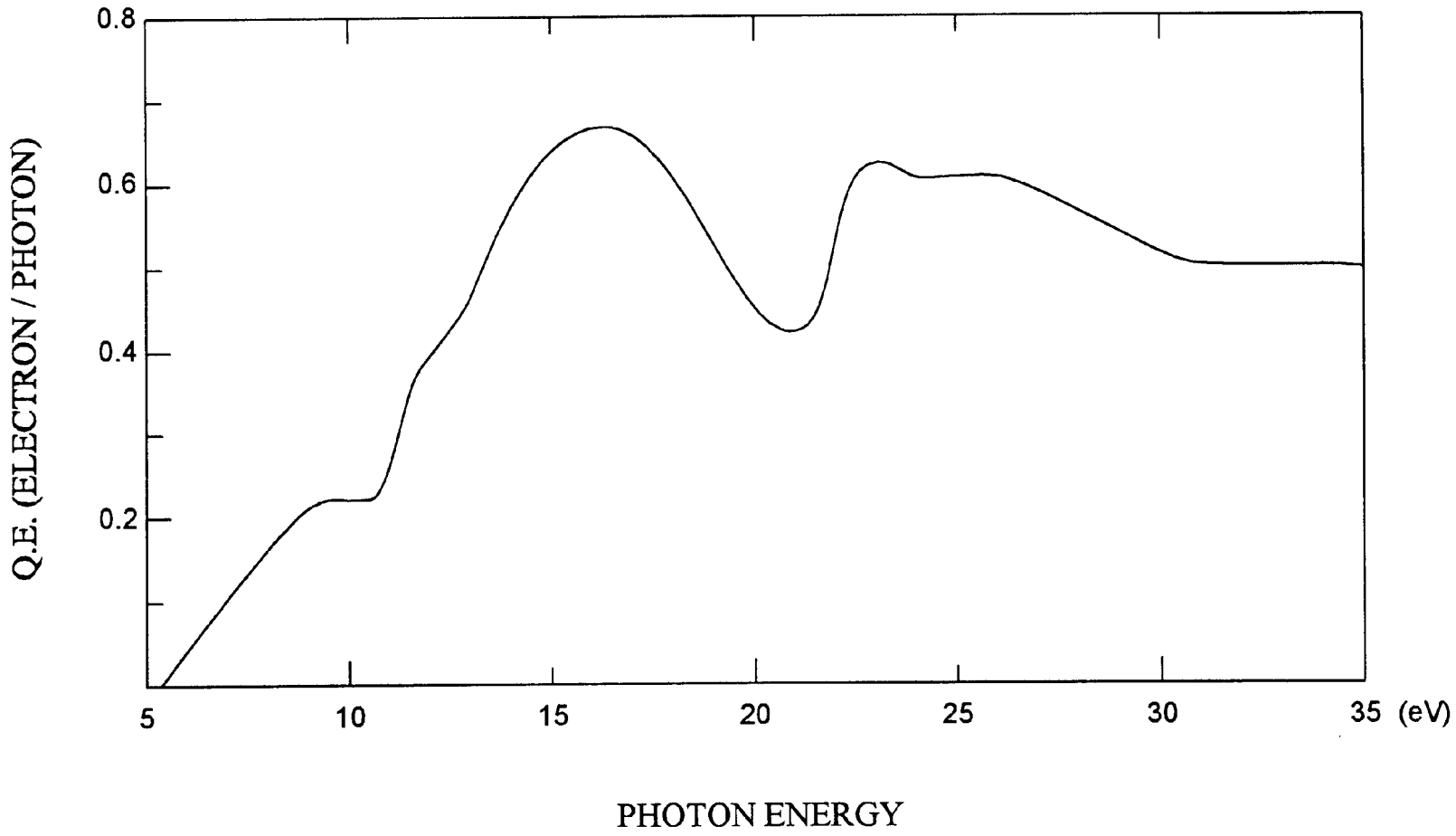
FIG. 3 is a graph showing a spectral sensitivety characteristic from (111) surface of a natural diamond doped with a p-type impurity.

By contrast, as shown in FIG. 8 or FIGS. 1 and 2, for example, the photocathode according to the present invention is an electrode which emits into a vacuum a photoelectron which is excited from a valence band to a conduction band by incident light. It is essentially different from the field emitter that emits into a vacuum the Fermi-level electron through a tunnel effect. Also, in the photocathode, a strong electric field on the surface is not always necessary. For the photocathode, field-emitted electrons generated by a strong electric field may become dark current and rather deteriorate its performance.

Thus, the field emitter having a diamond semiconductor layer and the photocathode according to the present invention belong to technical fields totally different from each other, and there is no relationship therebetween.

In the following, formation of such transmission type photocathode 30 and manufacture of the electron tube 10 equipped therewith will be explained. First, by means of glass, the anode 40 is placed within a housing which serves as a main body of the vacuum container 20. Here, an opening 21 is provided for evacuating air from the vacuum chamber 20. Subsequently, in order to form the transmission type photocathode 30, microwave plasma CVD (Chemical Vapor Deposition) technique employing a microwave-excited plasma discharge chamber (not depicted), for example, is used to form a polycrystalline diamond thin film on the entrance faceplate 31. Namely, the entrance faceplate 31 is placed within the plasma discharge chamber, and a material gas comprising a mixture of CO and $H_2$, for example, is introduced into the plasma discharge chamber. Thereafter, a microwave is used to discharge and decompose the material gas within the plasma discharge chamber, whereby a polycrystalline diamond thin film is deposited on the entrance faceplate 31. In order to turn the polycrystalline diamond thin film into a p-type semiconductor layer, a predetermined ratio of diborane ($B_2H_6$) is introduced during the deposition process. In particular, for favorable doping, it is preferred that the ratio of supplied carbon to boron at the time of deposition be 1,000:1 to 10,000:1.

Though it is riot always necessary for the polycrystalline diamond semiconductor to be doped with boron so as to be turned into a p-type semiconductor, it is preferable to do so for attaining a higher quantum efficiency. Also, when forming the polycrystalline diamond thin film, though microwave plasma CVD is used in this embodiment, the method of formation should not be restricted thereto. For example, hot filament CVD technique or the like may be used therefor.

Subsequently, thus obtained polycrystalline diamond thin film, i.e., transmission type photocathode 30, is left in a hydrogen plasma atmosphere for several minutes, whereby its surface is terminated with hydrogen.

After the transmission type photocathode 30 made of thus hydrogen-terminated polycrystalline diamond thin film (H/Diamond) is taken out into the air, the entrance faceplate 31 is attached to one end of the housing. Further, the transmission type photocathode 30 is subjected to degassing at about 200° C. for several hours in the state where the inside of the vacuum container 20 is evacuated through the opening 21 to an ultrahigh vacuum at a pressure of about $1\times10^{-8}$ torr or more preferably $1\times10^{-10}$ torr or less. Since the surface of the NEA transmission type photocathode 30 having such characteristics tends to be heavily influenced by the remaining gas or the like, it is necessary for the surface to be clean in atomic level in order to maintain the photocathode 30. Thereafter, the vacuum container 20 is chipped off (i.e., the vacuum container 20 attached to the inside of an evacuation unit through the opening 21 is separated from the evacuation unit without breaking the vacuum state within the vacuum container 20) so as to seal the opening 21, whereby the desired electron tube 10 is obtained.

The hydrogen termination process of the polycrystalline diamond thin film surface is not restricted to that mentioned above. For example, after the entrance faceplate 31 provided with the polycrystalline diamond thin film is attached to the vacuum container 20, the inside of the vacuum container 20 is evacuated to a vacuum of about $1\times10^{-8}$ torr, and degassing is effected at about 200° C. for several hours. Thereafter, about $1\times10^{-3}$ torr of hydrogen is introduced into the vacuum container 20, and the transmission type photocathode 30 is heated to about 300° C. by the tangsten filament equipped in the vacuum container, whereby the surface is terminated with hydrogen. Hydrogen enclosed within the vacuum container 20 constituting the electron tube 10 chemically stabilizes the surface of the polycrystalline diamond thin film. Thereafter, the vacuum container 20 is chipped off, whereby obtained is the electron tube 10 that operates quite stably. Thus obtained electron tube 10, as with that mentioned above, can attain a high sensitivity, i.e., quantum efficiency of 12% or higher (the quantum efficiency of the photocathode itself corrected on the basis of the transmittance of the entrance faceplate 31 being 24% or higher), with a good reproducibility.

Here, it is important for hydrogen to be enclosed with a partial pressure at least lower than $1\times10^{-3}$ torr but higher than $1\times10^{-6}$ torr. It is due to the fact that there is a stronger possibility that discharge might occur in the electron tube 10 when the partial pressure of hydrogen is higher than $1\times10^{-3}$ torr. Below $1\times10^{-6}$ torr, on the other hand, it takes a very long time for hydrogen to be absorbed again after being desorbed from the polycrystalline diamond thin film surface. Consequently, other remaining molecules in the vacuum container 20 are likely to be absorbed by the pollcrystalline diamond thin film surface, thus losing the effect resulting from enclosed hydrogen.

The transmission type photocathode 30 according to the present invention should not be restricted to the above-mentioned example. In the above-mentioned photocathode 30 (H/Diamond), in order to lower its work function, the surface of the polycrystalline diamond thin film is terminated with hydrogen. In the photocathode 30, in order to further lower the work function of the surface, an active layer made of an alkali metal such as Cs or its compound may be disposed on the surface of the hydrogen-terminated polycrystalline diamond thin film (thus yielding Cs/H/Diamond, for example). Though the alkali metal in this active layer is exemplified by Cs, without being restricted thereto, other alkali metals such as K, Rb, Na, and the like may be used. Similar actions and effects can also be obtained when the active layer is made of a compound such as an oxide or fluoride of an alkali metal. Further, an active layer combining together a plurality of the above-mentioned alkali metals or their oxides or fluorides may be applied to the transmission type photocathode 30.

In the following, concerning a reflection type photocathode according to the present invention, a method of synthesizing its polycrystalline diamond thin film and a method of making the reflection type photocathode will initially be explained.

Figure 11:
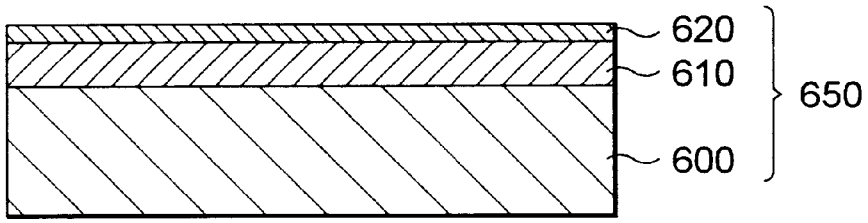
FIG. 11 is a sectional view showing a configuration of a reflection type photocathode according to the present invention.

First, as shown in FIG. 11, a commercially-available, inexpensive Si (100) substrate 600 having a thickness of about 0.5 mm is prepared, and a polycrystalline diamond thin film 610 (p-Diamond) doped with boron (B) having a thickness of about 5 $\mu$m is synthesized thereon by means of low-pressure microwave plasma CVD. Specifically, $CH_4$ is used as a material gas, while $B_2H_6$ is used as a dopant gas. These gases are supplied as being mixed with $H_2$ gas. The synthesizing temperature is 850° C., the reaction pressure is 50 torr, the microwave output is 1.5 W, and the film-forming rate is 0.5 $\mu$m/h. After the film is completely formed, only the material gas $CH_4$ and the dopant gas $B_2H_6$ are stopped and $H_2$ gas is kept from being supplied for about 5 minutes, whereby the p-type polycrystalline diamond thin film 610 with a hydrogen-terminated surface (H/p-Diamond) is obtained.

Figure 12:
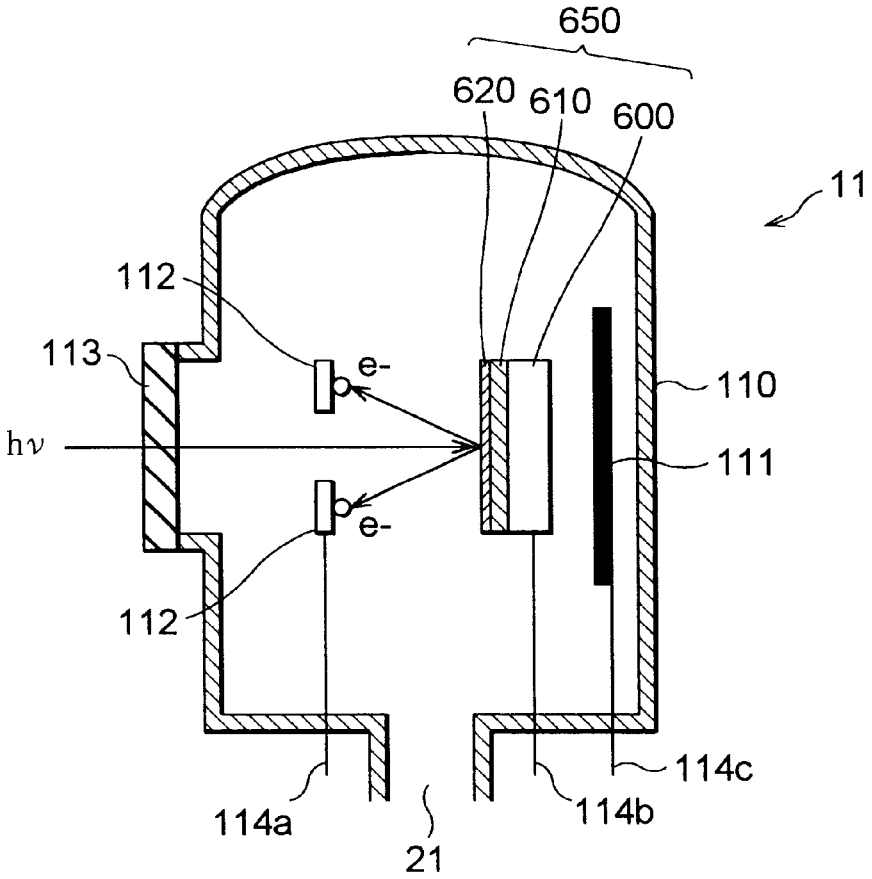
FIG. 12 is a sectional view showing a configuration of an electron tube equipped with the reflection type photocathode according to the present invention shown in FIG. 11.

Subsequently, thus synthesized sample is taken out from the low-pressure microwave CVD system and is incorporated in an electron tube (phototube) 11 shown in FIG. 12. This electron tube 11 is constituted by the Si (100) substrate 600; the polycrystalline diamond thin film 610, synthesized on the substrate 600, for constituting a part of a reflection type photocathode 650; an active layer 620 formed on the surface of the polycrystalline diamond thin film 610; an annular anode 112 for collecting emitted photoelectrons; an entrance window 113, made of $MgF_2$ which is a material transparent to ultraviolet rays, functioning as a window to incident light (light to be detected); a vacuum container 110 made of a glass bulb; lead pins 114*a* and 114*b* embedded in a part of the vacuum container 110 in order to be electrically connected to the photocathode 650 and the anode 112, respectively; a Cs sleeve 111 and a lead pin 114*c* electrically connected to the Cs sleeve 111. This electron tube 11 is attached to an evacuation unit through the opening 21, and after its inside is evacuated to a vacuum of about $10^{-8}$ torr, it is subjected to baking at about 200° C. for degassing.

Further, in order to lower the work function of the surface of the hydrogen-terminated p-type diamond thin film 610 (H/p-Diamond), Cs and $O_2$ are alternately supplied, whereby the CsO active layer 620 on the order of a single-atom layer is formed on the p-type diamond thin film 610 (H/p-Diamond). Thus, the photocathode 650 (CsO/H/p-Diamond) is obtained. Here, the CsO active layer 620 may be simply formed by a process in which the commercially-available Cs sleeve 111 is heated by electric conduction so as to supply Cs, while high-purity $O_2$ is caused to leak into the vacuum container 110 through a leak valve. Here, when the photoelectron emission current from the anode 112 is monitored while the CsO active layer 620 is irradiated with ultraviolet light, the optimum thickness of the CsO active layer 620 can be controlled with a good reproducibility. Thereafter, the opening 21 of the electron tube 11 is closed.

Figure 13:
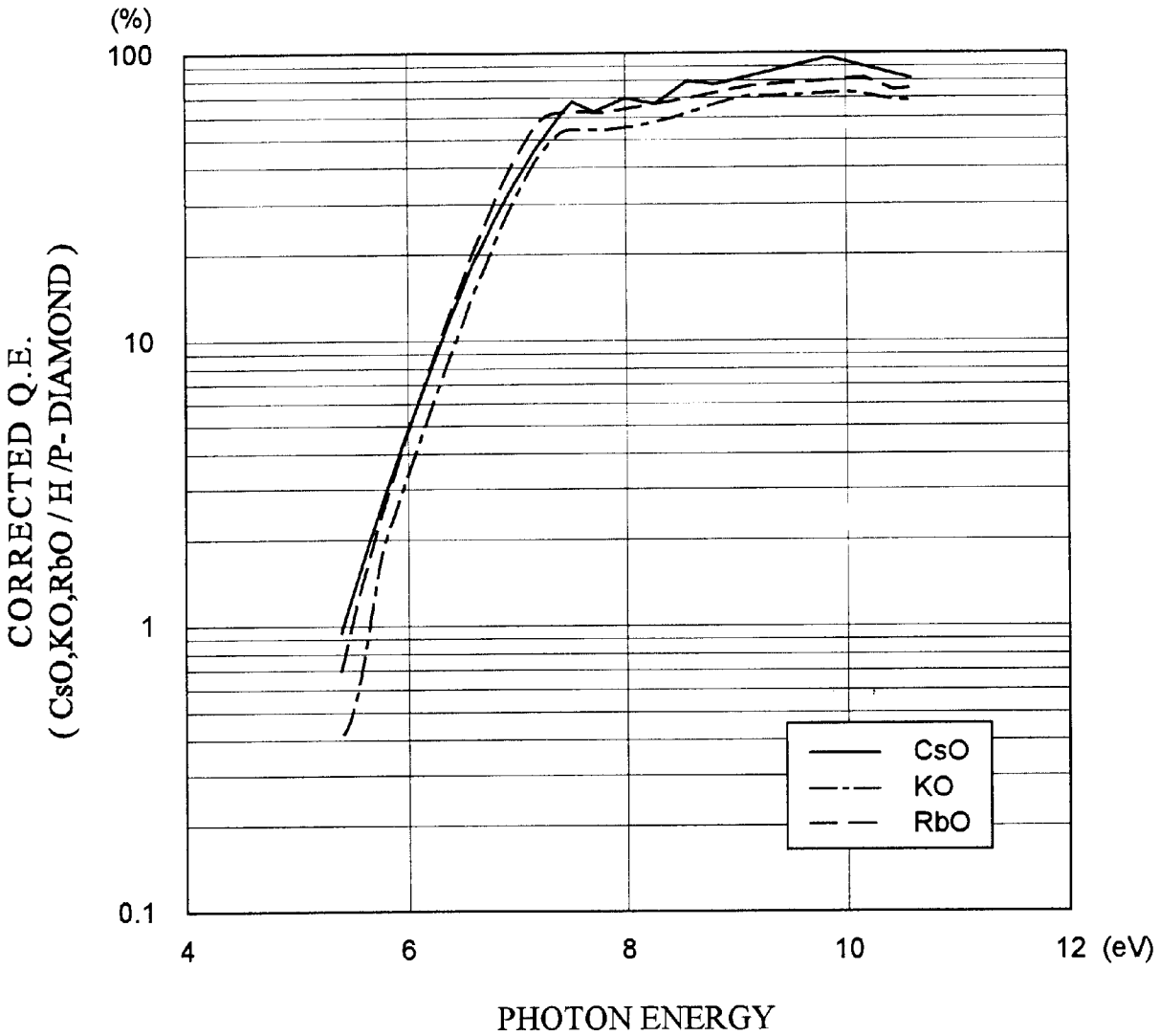
FIG. 13 is a (first) graph showing a spectral sensitivity characteristic of an electron tube equipped with first examples (CsO, KO, RbO/H/p-Diamond) of the reflection type photocathode according to the present invention, whose abscissa and ordinate respectively indicate the photon energy (eV) and the quantum efficiency Q.E. (%) of the photocathode itself corrected on the basis of the transmittance of its entrance faceplate with respect to light to be detected, in which plotted are respective cases where active layers are made of CsO, KO, and RbO.

FIG. 13 shows a spectral sensitivity characteristic of thus obtained electron tube 11 in the ultraviolet region. The incident light reaches the reflection type photocathode 650 through the $MgF_2$ window 113 (entrance faceplate) disposed at a part of the vacuum container 110, and is absorbed by the polycrystalline diamond thin film 610 of the reflection type photocathode 650, whereby photoelectrons are excited. Thus excited photoelectrons reach the surface of the polycrystalline diamond thin film 610 due to diffusion. Here, since the surface of the polycrystalline diamond thin film 610 has a lower work function due to the action of the active layer 620, the photoelectrons can easily escape into a vacuum. Actually, the inventors have found that, as shown in FIG. 13, quite high quantum efficiencies, i.e., 90% at the maximum in the case of a photocathode whose active layer 620 is CsO (CsO/H/p-Diamond), 80% at the maximum in the case of a photocathode whose active layer 620 is RbO (RbO/H/p-Diamond), and 70% at the maximum in the case of a photocathode whose active layer 620 is KO (KO/H/p-Diamond), can be obtained. Here, the quantum efficiency indicated by the ordinate of FIG. 13 is the net quantum efficiency Q.E. (%) of the polycrystalline diamond thin film 610 corrected on the basis of the transmittance of the $MgF_2$ entrance faceplate 113 in the ultraviolet region. These quantum efficiency levels are much higher than the quantum efficiency of 20% with respect to a similar incident photon energy (eV) in the natural monocrystal diamond reported in the above-mentioned Himpsel reference, thus plainly indicating the effectiveness of the present invention. It is assumed to be attributable to the fact that, since the photocathode according to the present invention is constituted by a polycrystalline diamond thin film having a large surface area, the probability at which the photoelectrons excited by the incident light reach their emitting surface is greater than that in a monocrystal diamond thin film having a flat surface. Further, though it may also result from the fact that the incident light is optically scattered at the individual crystalline grain boundaries and thereby increases the absorption coefficient, it is considered to be more attributable to the further decrease in work function caused by the active layer made of an alkali metal or its oxide.

Thus, since the photocathode 650 according to the present invention comprises polycrystalline diamond or a material mainly composed of polycrystalline diamond, and further comprises the active layer 620 made of an alkali metal or its oxide for lowering its work function, it can realize a photocathode exhibiting a higher performance at a lower cost more easily as compared with the conventional photocathode using the monocrystal diamond.

In the above-mentioned reflection type photocathode 650, the B-doped p-type polycrystalline diamond thin film 610 is employed. Though a p-type polycrystalline diamond thin film is preferably used in the photocathode 650, in order to improve the quantum efficiency, it should not always be restricted to p-type. As will be explained later, however, according to the results of experiments conducted by the inventors, the quantum efficiency of an undoped polycrystalline diamond thin film was about ½ that of the B-doped p-type polycrystalline diamond thin film.

In the reflection type photocathode 650, the surface of the polycrystalline diamond thin film 610 is terminated with hydrogen. Though a hydrogen-terminated photocathode is preferable in order to secure chemical stability, the photocathode should not be restricted thereto from the viewpoint of photoelectron emission efficiency. Similar effects may be obtained without any intentional surface termination in particular.

Though the polycrystalline diamond thin film 610 on the Si substrate 600 is synthesized by microwave plasma CVD in the photocathode 650, the substrate may be constituted by any of other semiconductors, metals, and the like without being restricted to Si. In order to obtain a photocathode having a desired characteristic with a good reproducibility, however, it is preferable to use an Si substrate which has a chemically stable crystalloid while being inexpensive. Though the whole photocathode according to the present invention should preferably be constituted by polycrystalline diamond, a certain degree of effects can be obtained even when it partially contains components which are not polycrystalline, e.g., components of graphite or diamond-like carbon. Accordingly, the photocathode according to the present invention should not be restricted to only that made of a complete polycrystalline diamond thin film.

The foregoing modified examples are also applicable to the transmission type photocathode according to the present invention except for the substrate (i.e., the $MgF_2$ entrance faceplate serves as a substrate in the case of the transmission type photocathode).

Figure 14:
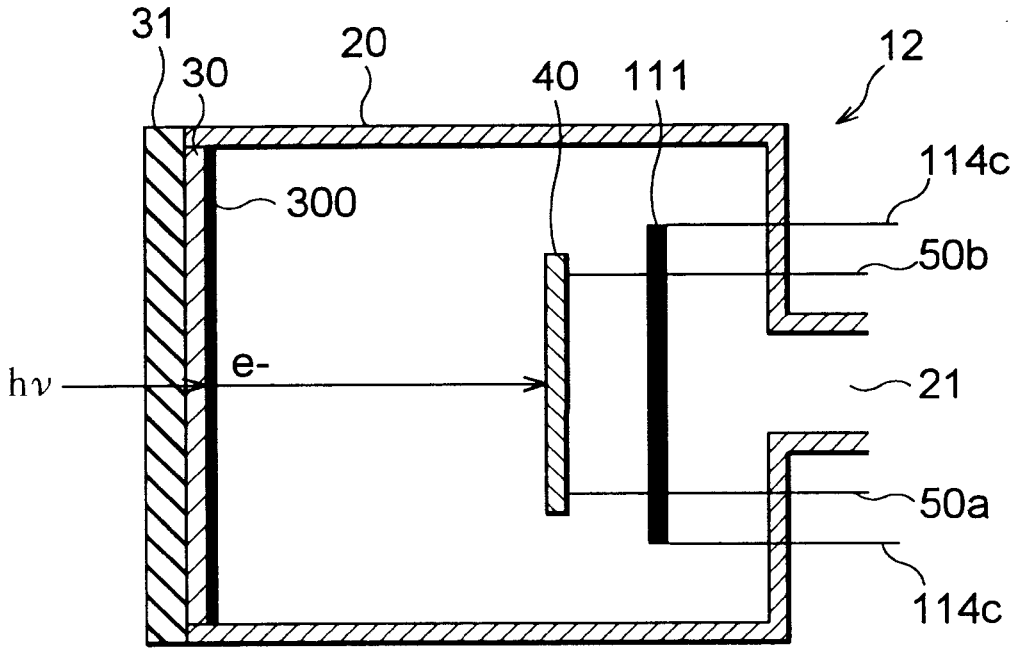
FIG. 14 is a sectional view showing a configuration of an electron tube equipped with a second example of the transmission type photocathode according to the present invention.

In the following, concerning the transmission type photocathode 30 according to the present invention, manufacture of an electron tube 12 equipped therewith will be explained with reference to FIG. 14. In order to incorporate the transmission type photocathode into the electron tube 12 shown in FIG. 14, unlike the example shown in FIG. 7, it is necessary for the Cs sleeve 111 to be placed within the housing constituting the vacuum container 20. Then, by resistance-heating the Cs sleeve 111, while irradiating the polycrystalline diamond thin film 30 with ultraviolet light from a high-pressure mercury lamp and monitoring the photoelectron emission current from the anode 40, an active layer 300 made of Cs is formed on the polycrystalline diamond thin film 30 (H/Diamond) having a hydrogen-terminated surface. When the photoelectron emission current is maximized, the resistance heating is terminated. Thereafter, the vacuum container 20 is chipped off from the evacuation unit, whereby the electron tube 12 is obtained.

Figure 15:
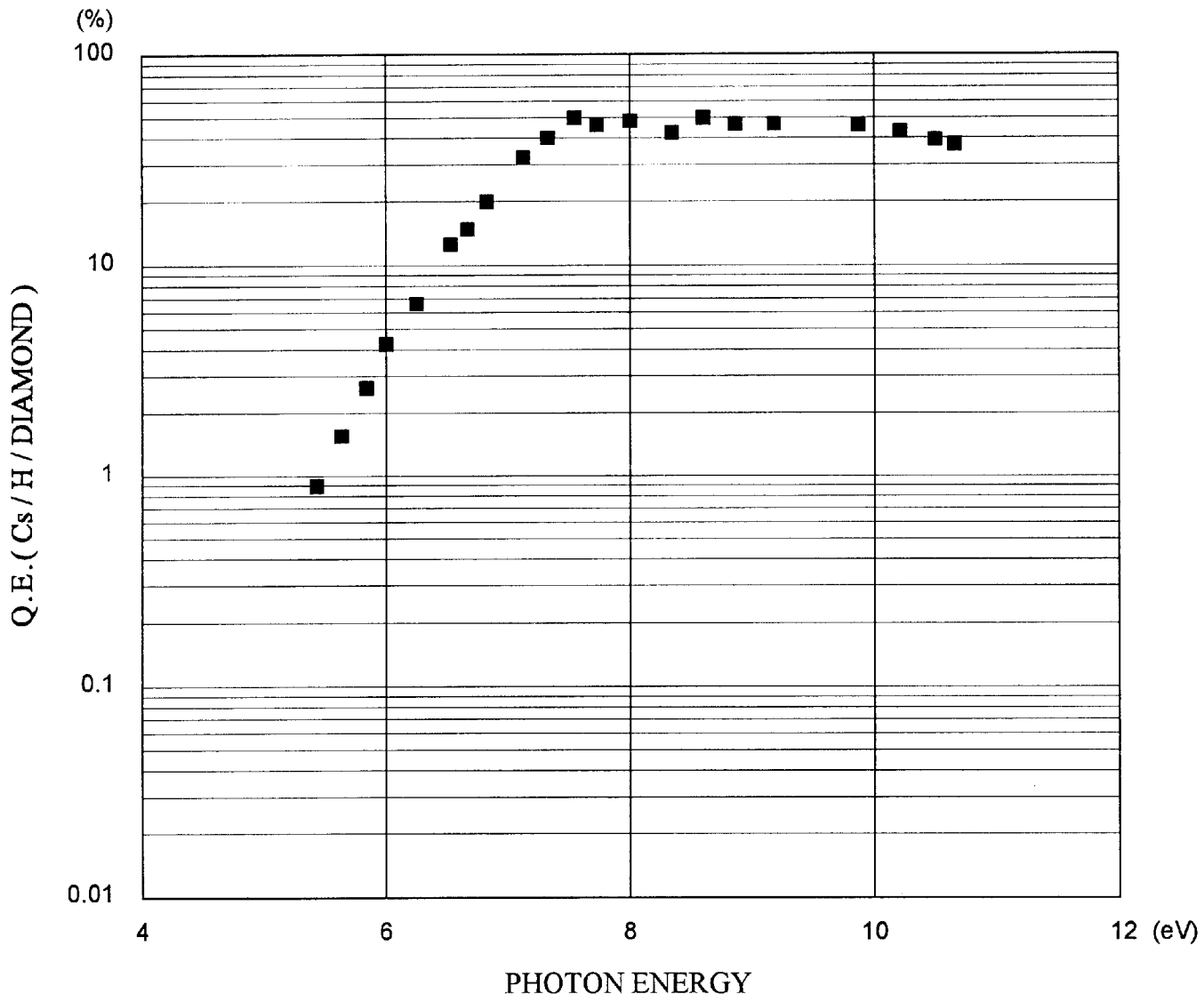
FIG. 15 is a graph showing a spectral sensitivity characteristic of an electron tube equipped with the second example (Cs/H/Diamond) of the transmission type photocathode according to the present invention, whose abscissa and ordinate respectively indicate the photon energy (eV) and the measured quantum efficiency Q.E. (%)

FIG. 15 is a graph showing a spectral sensitivity characteristic of thus obtained electron tube 12 equipped with a second example (Cs/H/Diamond) of the transmission type photocathode according to the present invention. As can be seen from this graph, the inventors have found that the actually-measured quantum efficiency Q.E. of the electron tube 12 is 45% or greater (the quantum efficiency corrected on the basis of the absorption coefficient of the entrance faceplate 31 being 90% or greater) and has a good reproducibility.

The element terminating the surface of the polycrystalline diamond thin film 30 in order to lower the work function thereof should not be limited to hydrogen mentioned above. Namely, similar effects can also be obtained when the surface of the polycrystalline diamond thin film 30 is terminated with oxygen.

Figure 16:
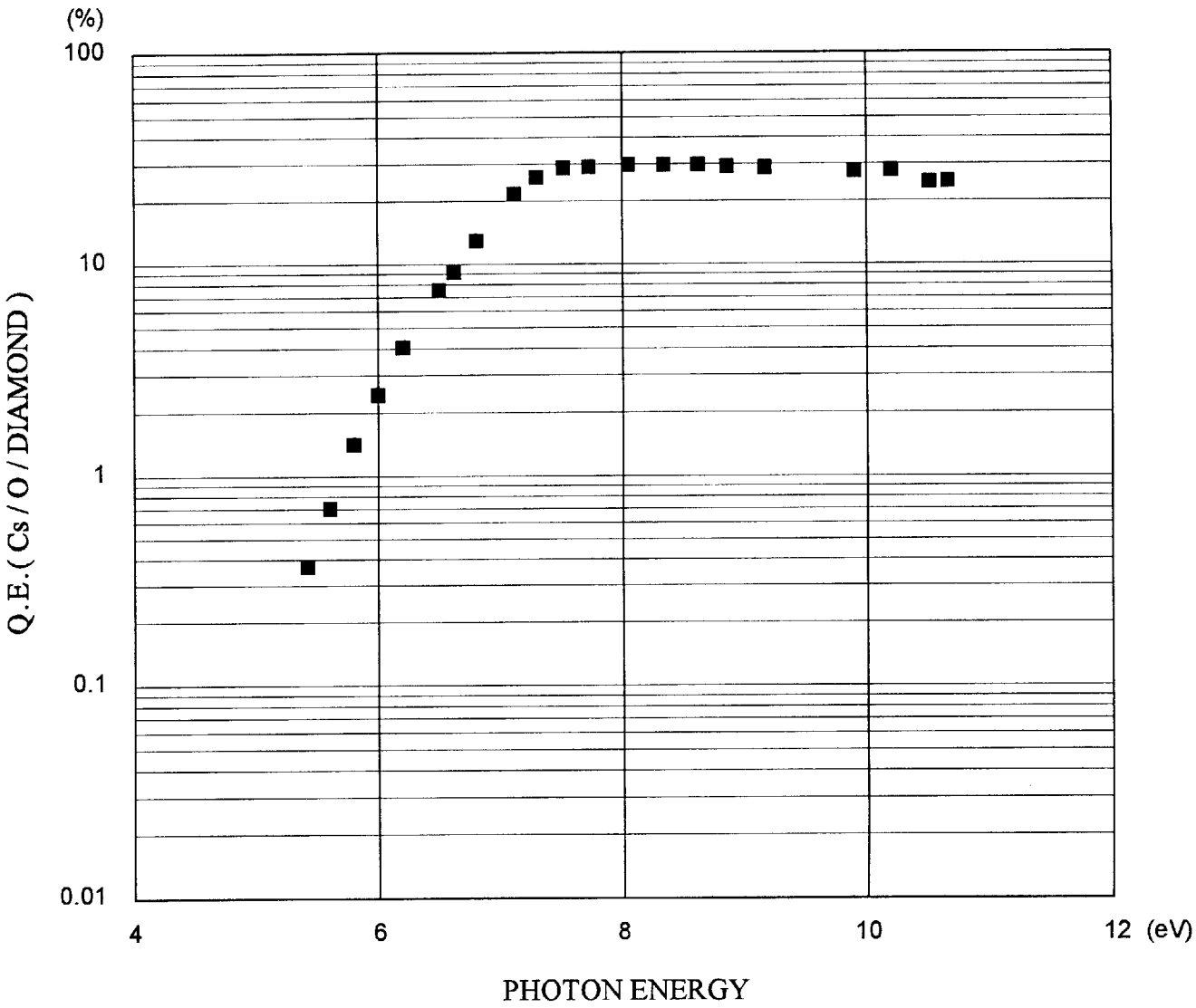
FIG. 16 is a graph showing a spectral sensitivity characteristic of an electron tube equipped with a third example (Cs/O/Diamond) of the transmission type photocathode according to the present invention, whose abscissa and ordinate respectively indicate the photon energy (eV) and the measured quantum efficiency Q.E. (%)

FIG. 16 is a graph showing a spectral sensitivity characteristic of the electron tube 12 incorporating therein a third example (Cs/O/Diamond) of the transmission type photocathode according to the present invention, i.e., photocathode comprising a polycrystalline diamond thin film with an oxygen-terminated surface and a Cs active layer disposed on the diamond thin film. Here, its ordinate indicates the actually-measured quantum efficiency Q.E. (not corrected).

As can be seen from this graph, the inventors have found that the quantum efficiency Q.E. of this photocathode is 30% or greater (the quantum efficiency corrected on the basis of the absorption coefficient of the entrance faceplate 31 being 60% or greater) and is excellent in reproducibility.

Though Cs is used as the material for the active layer in the third example, without being restricted thereto, any of alkali metals other than Cs or compounds such as oxides or fluorides of alkali metals may also be employed. Further, an active layer combining together a plurality of the above-mentioned alkali metals or their oxides or fluorides may be applied to the transmission type photocathode.

Explained in the following are results of experiments conducted by the inventors concerning effects obtained when the conduction type of the polycrystalline diamond thin film is set to p-type. Each sample prepared in the following experiments is a reflection type photocathode formed on an Si substrate.

First, prepared were an Si substrate whose surface was provided with a B-doped p-type polycrystalline diamond thin film and an Si substrate whose surface was provided with an undoped polycrystalline diamond thin film. Then, each of thus prepared Si substrates was incorporated into an electron tube having an $MgF_2$ entrance faceplate, which was similar to the electron tube shown in FIG. 12, and was baked at 200° C. Subsequently, at a temperature of 350° C. with an $H_2$-partial pressure of $5\times10^{-3}$ torr, the surface of the polycrystalline diamond thin film was terminated with hydrogen by means of hot filament technique. Thereafter, at room temperature, by using a low-pressure Hg lamp as a light source, the surface of the polycrystalline diamond thin film placed within the vacuum container was activated with Cs and O (a CsO active layer was formed on the polycrystalline diamond thin film), whereby samples of second examples (CsO/H/p-Diamond, and CsO/H/Diamond) in the reflection type photocathode were obtained. Here, the method of activation was totally the same as that in the case of GaAs, i.e., Yo-Yo technique in which Cs and $O_2$ were alternately supplied into the vacuum container. After these electron tubes were chipped off from the evacuation unit, the spectral sensitivity of each electron tube was measured.

Figure 17:
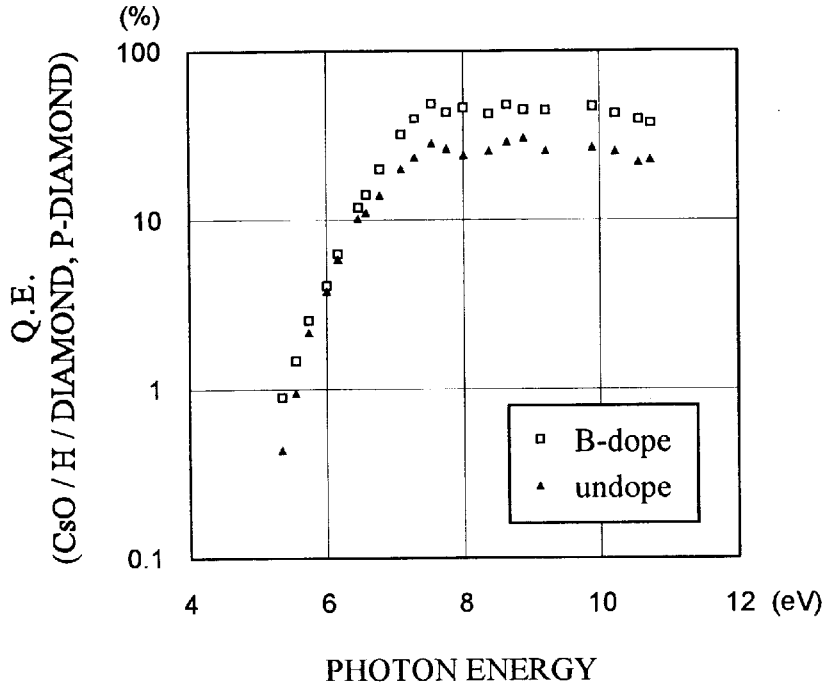
FIG. 17 is a graph showing a spectral sensitivity characteristic of an electron tube equipped with second examples (CsO/H/Diamond, p-Diamond) of the reflection type photocathode according to the present invention, whose abscissa and ordinate respectively indicate the photon energy (eV) and the quantum efficiency Q.E. (%) of the photocathode itself corrected on the basis of the transmittance of its entrance faceplate with respect to light to be detected, in which plotted are respective cases of polycrystalline diamond layers doped with and undoped with a p-type impurity.
Figure 18:
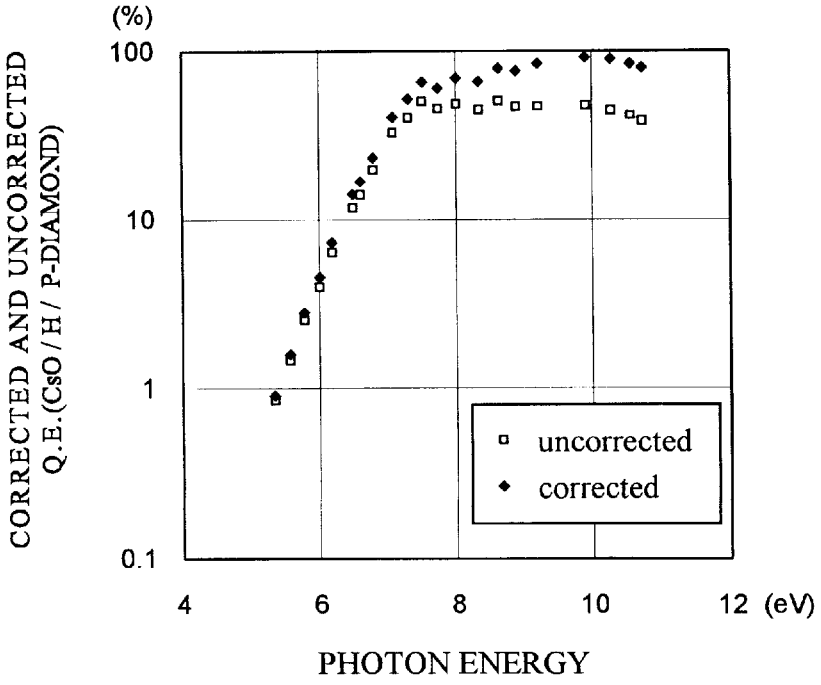
FIG. 18 is a graph plotting the measured quantum efficiency Q.E. (%) and the quantum efficiency Q.E. (%) of the photocathode itself corrected on the basis of the transmittance of its entrance faceplate with respect to light to be detected concerning the polycrystalline diamond layer doped with a p-type impurity that is shown in FIG. 17.

FIG. 17 is a graph showing the respective spectral sensitivity characteristics of the electron tube incorporating therein the sample (CsO/H/p-Diamond) having the B-doped p-type polycrystalline diamond thin film and the electron tube incorporating therein the sample (CsO/H/Diamond) having the undoped p-type polycrystalline diamond thin film. Here, in FIG. 17, the abscissa indicates the photon energy (eV), while the ordinate indicates the actually-measured quantum efficiency Q.E. (%) of each sample. FIG. 18 is a graph concerning the sample having the p-type polycrystalline diamond thin film, in which both of the actually-measured quantum efficiency Q.E. (photon/electron) and the quantum efficiency Q.E. (photon/electron) corrected on the basis of the transmittance of the $MgF_2$ entrance faceplate are plotted. As can be seen from FIG. 17, as the maximum sensitivity, very high levels of quantum efficiency Q.E., i.e., 49% in the B-doped sample and 30% in the undoped sample, were obtained. The difference in quantum efficiency Q.E. therebetween, which will be explained later in detail, is not caused by the difference in their surface states but by the difference in band-bending directions within diamond. Here, the quantum efficiency Q.E. of 49%, even as the value before being corrected, is about twice as high as the sensitivity of the above-mentioned CsI photocathode.

Next, when the actual quantum efficiency of the B-doped sample is estimated (FIG. 18 being a graph showing the spectral sensitivity characteristic corrected on the basis of the transmittance of the $MgF_2$ entrance faceplate that serves as a window member), since the transmittance of the $MgF_2$ entrance faceplate drastically decreases on the short wavelength side in particular, the quantum efficiency Q.E. corrected in the vicinity of a wavelength range of 110 to 135 nm exhibits a very high sensitivity of 80% to 96% as the maximum sensitivity (see FIG. 18). This sensitivity is much higher than the level, 20%, reported by Himpsel et al. within this wavelength region in the (111) surface of monocrystal diamond. Accordingly, an ideal NEA photocathode is assumed to be realized here.

When the electron affinity of the polycrystalline diamond thin film surface is estimated, the threshold energy is about 5.2 eV, and assuming that the Eg of diamond is 5.5 eV, a negative electron affinity (NEA) of at least 0.3 eV is attained. Though a slightly positive electron affinity has been estimated in the conventional diamond thin film that is simply terminated with hydrogen, it is assumed to have locally attained NEA. In this example, due to the further activation with CsO (as the CsO active layer is disposed on the polycrystalline diamond thin film surface), substantially the whole surface of the polycrystalline diamond thin film is assumed to have attained NEA, thereby yielding a sample (photocathode) having a high quantum efficiency Q.E. Also, since the surface level of the polycrystalline diamond thin film has become very low due to hydrogen termination, it is assumed that there is no gap like that expected in the CsO/GaAs photocathode with respect to the vacuum level, whereby an ideal NEA surface is formed.

Figure 19:
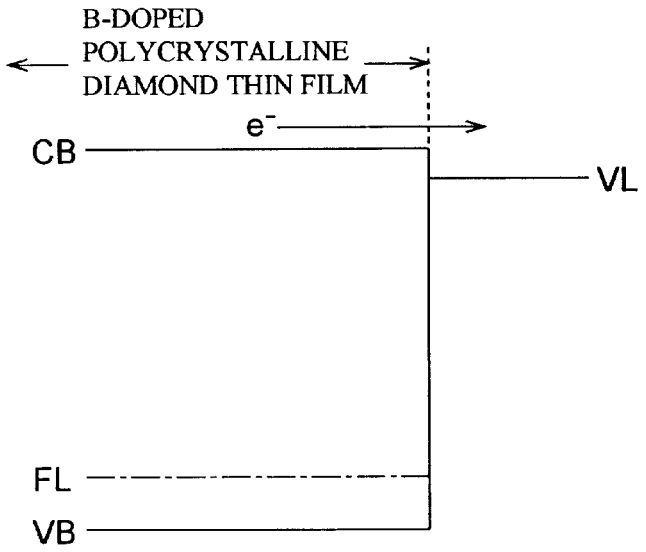
FIG. 19 is an energy band diagram for explaining a process in which a photoelectron is emitted from a polycrystalline diamond layer doped with a p-type impurity.
Figure 20:
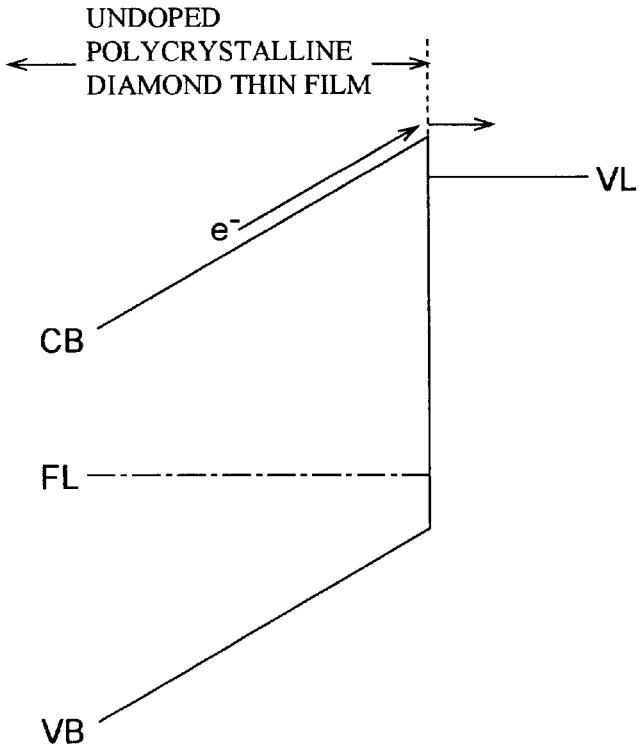
FIG. 20 is an energy band diagram for explaining a process in which a photoelectron is emitted from a polycrystalline diamond layer undoped with a p-type impurity.

FIGS. 19 and 20 show expected energy band diagrams of polycrystalline diamond thin film surfaces. The difference between the B-doped p-type polycrystalline diamond thin film and the undoped polycrystalline diamond thin film is a difference in the probability of photoelectrons reaching the surface which results from the fact that their band-bending directions differ within the polycrystalline diamond thin film. Accordingly, regardless of the surface state, the undoped polycrystalline diamond thin film is always assumed to have a quantum efficiency which is about ½ that of the B-doped polycrystalline diamond thin film.

As a result of the foregoing spectral sensitivity measurement, it has been found that high levels of quantum efficiency Q.E., i.e., 49% (without correction) in the B-doped sample and 30% (without correction) in the undoped sample, can be obtained. Further, it has been found that, when corrected on the basis of the transmittance of the $MgF_2$ entrance faceplate, the B-doped sample exhibits a very high sensitivity, i.e., quantum efficiency of 80% to 95%, thus realizing an ideal NEA photocathode.

Explained in the following are experiments conducted by the inventors in order to observe the chemical stability of the photocathode according to the present invention. Also, each sample prepared in the following experiments is a reflection type photocathode formed on an Si substrate.

Thus prepared sample was a CsO/H/p-Diamond photocathode disposed on the above-mentioned Si substrate, and the electron tube incorporating therein this sample was subjected to air leak. Then, the electron tube was attached to the evacuation unit again so as to effect baking at 200° C. for 4 hours and, without any processing, was chipped off from the evacuation unit. Subsequently, the spectral sensitivity of thus obtained electron tube was measured again.

Figure 21:
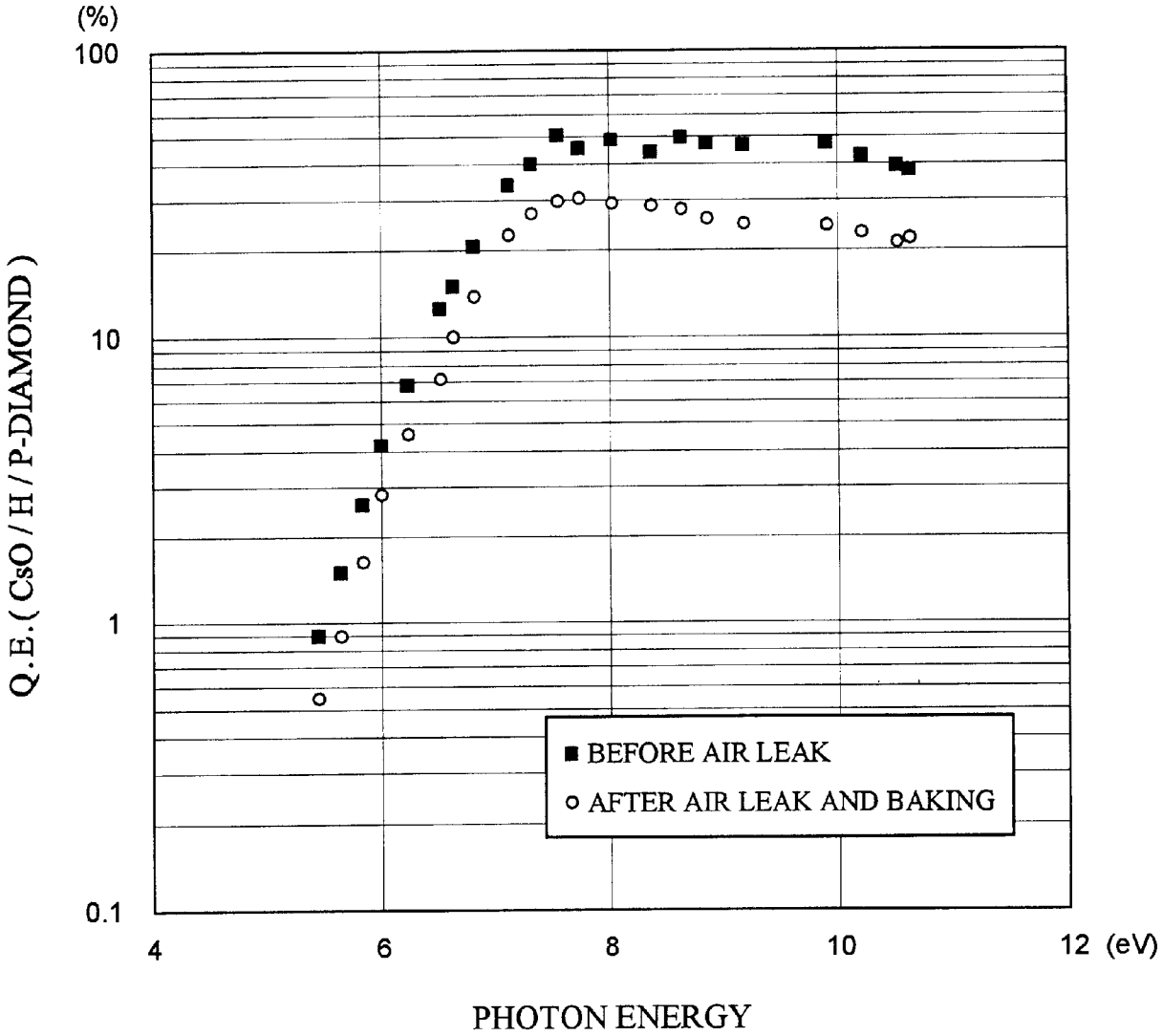
FIG. 21 is a graph showing a spectral sensitivity characteristic of an electron tube equipped with a part of the second examples (CsO/H/p-Diamond) of the reflection type photocathode according to the present invention in order to observe its stability, whose abscissa and ordinate respectively indicate the photon energy (eV) and the measured quantum efficiency Q.E. (%), in which plotted are respective cases before and after air leak.

FIG. 21 is a graph showing, for comparison, the actually-measured quantum efficiency Q.E. (%) of the CsO/H/p-Diamond photocathode before and after air leak. As can be seen from this graph, the CsO/H/p-Diamond photocathode after air leak and baking (third example of the reflection type photocathode according to the present invention) exhibited a considerably high quantum efficiency Q.E., i.e., 30% at the maximum even after being baked at 200° C. after the air leak. It corresponds to a sensitivity of about 60% of that prior to the air leak. This fact indicates that, for example, even when activation with CsO (i.e., formation of the CsO active layer on the polycrystalline diamond thin film) is collectively effected by means of an enormous evacuation unit, and then the resulting photocathode is once exposed to the air so as to be connected to an electron tube such as photomultiplier, the electron tube having a quantum efficiency of 30%, as the photocathode, can be obtained when simply baked at 200° C. Accordingly, indicated is a possibility of innovative mass production which may totally change the conventional method of making a photocathode. Of course, it should not be restricted to the photocathode. For example, a dynode as a secondary electron surface may be made by totally the same method. Namely, the photocathode according to the present invention is totally different from the NEA photocathode such as that made of GaAs and totally overturns the common sense concerning the conventional photocathode that is very sensitive to air and water.

Also, the estimated threshold energies in both samples are about 5.2 eV and do not differ from each other greatly, thus establishing a negative electron affinity (NEA). It indicates that the surface of each photocathode is kept from being influenced by baking, and that the difference between them (samples before and after baking) is attributable to the photoelectrons captured by molecules of water, organic matters, or the like absorbed thereon. Namely, this fact indicates that, when the baking temperature is optimized so as to eliminate these absorbed matters, the sensitivity may further be raised, and there is a possibility of an inherent high quantum efficiency Q.E. being obtained.

Even after being baked at 200° C. for 4 hours after once being exposed to the air, thus obtained CsO/H/p-Diamond photocathode can maintain about 60% of its sensitivity before baking, thus exhibiting a high quantum efficiency Q.E. of 30% at the maximum (corresponding to 60% in the quantum efficiency corrected on the basis of the transmittance of the $MgF_2$ entrance faceplate). Accordingly, the CsO-activated polycrystalline diamond photocathode is chemically stable to a considerable extent, thus making it sufficiently possible to establish a totally new mass-production technique for a photocathode or for a secondary electron surface of a dynode.

Further, the inventors conducted experiments for observing the chemical stability of an oxygen-terminated sample (photocathode having a polycrystalline diamond thin film).

The prepared sample was a polycrystalline diamond thin film disposed or an Si substrate as mentioned above and whose surface was terminated with hydrogen. While $O_2$ was introduced at a partial pressure of $5\times10^{-3}$ torr through an Ag tube, the sample was heated to 350° C., whereby its surface was terminated with oxygen. Then, Cs and O were alternately introduced to effect surface activation (formation of a CsO active layer). Thereafter, thus obtained electron tube was chipped off from the evacuation unit and subjected to spectral sensitivity measurement. On the other hand, this electron tube was subjected to air leak, attached to the evacuation unit again, baked at 200° C. for 4 hours, chipped off from the evacuation unit without any processing thereafter, and then subjected to spectral sensitivity measurement.

Figure 22:
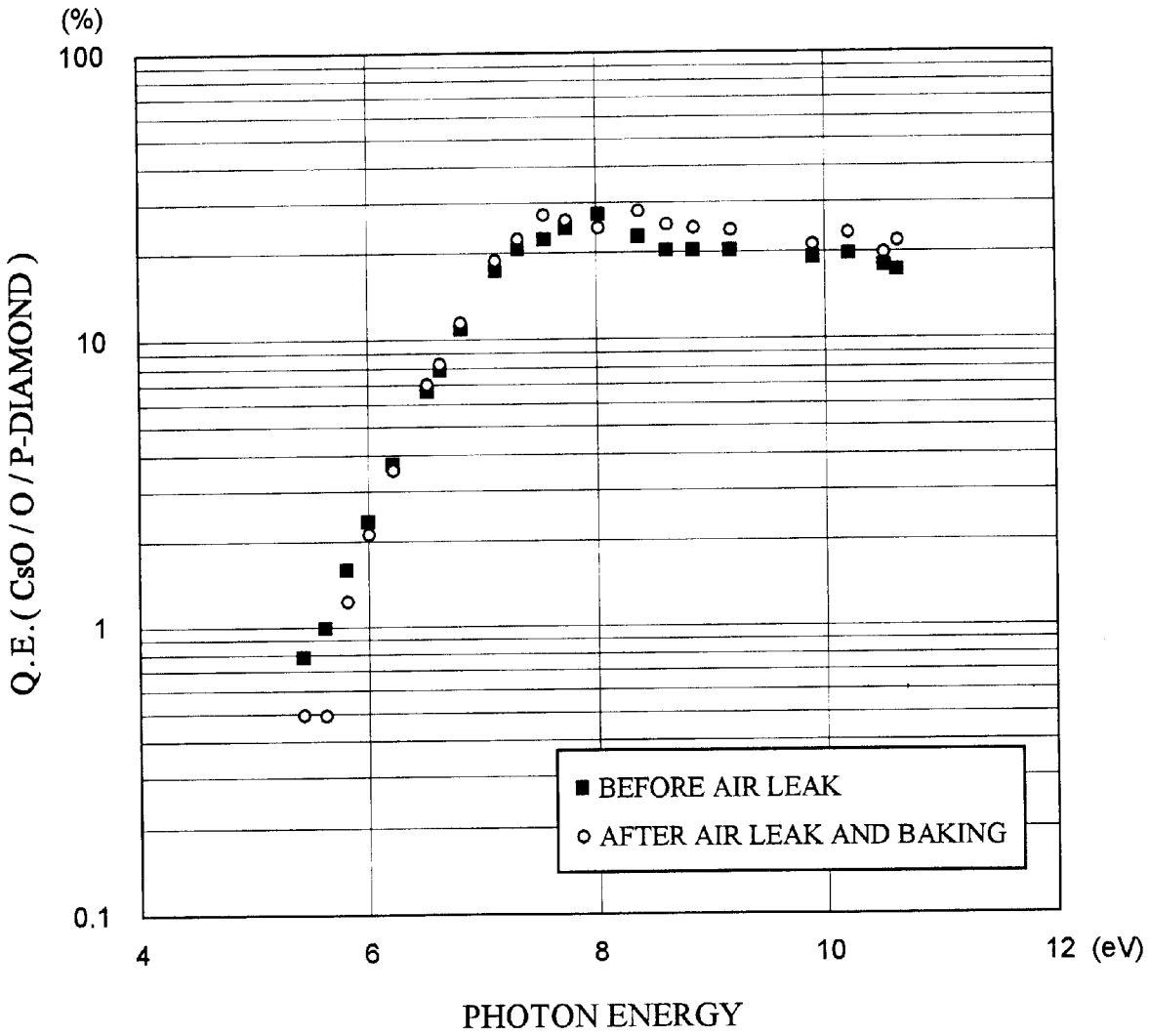
FIG. 22 is a (first) graph showing a spectral sensitivity characteristic of an electron tube equipped with a third example (CsO/O/p-Diamond) of the reflection type photocathode according to the present invention, whose abscissa and ordinate respectively indicate the photon energy (eV) and the measured quantum efficiency Q.E. (%), in which plotted are respective cases be:ore and after air leak.
Figure 23:
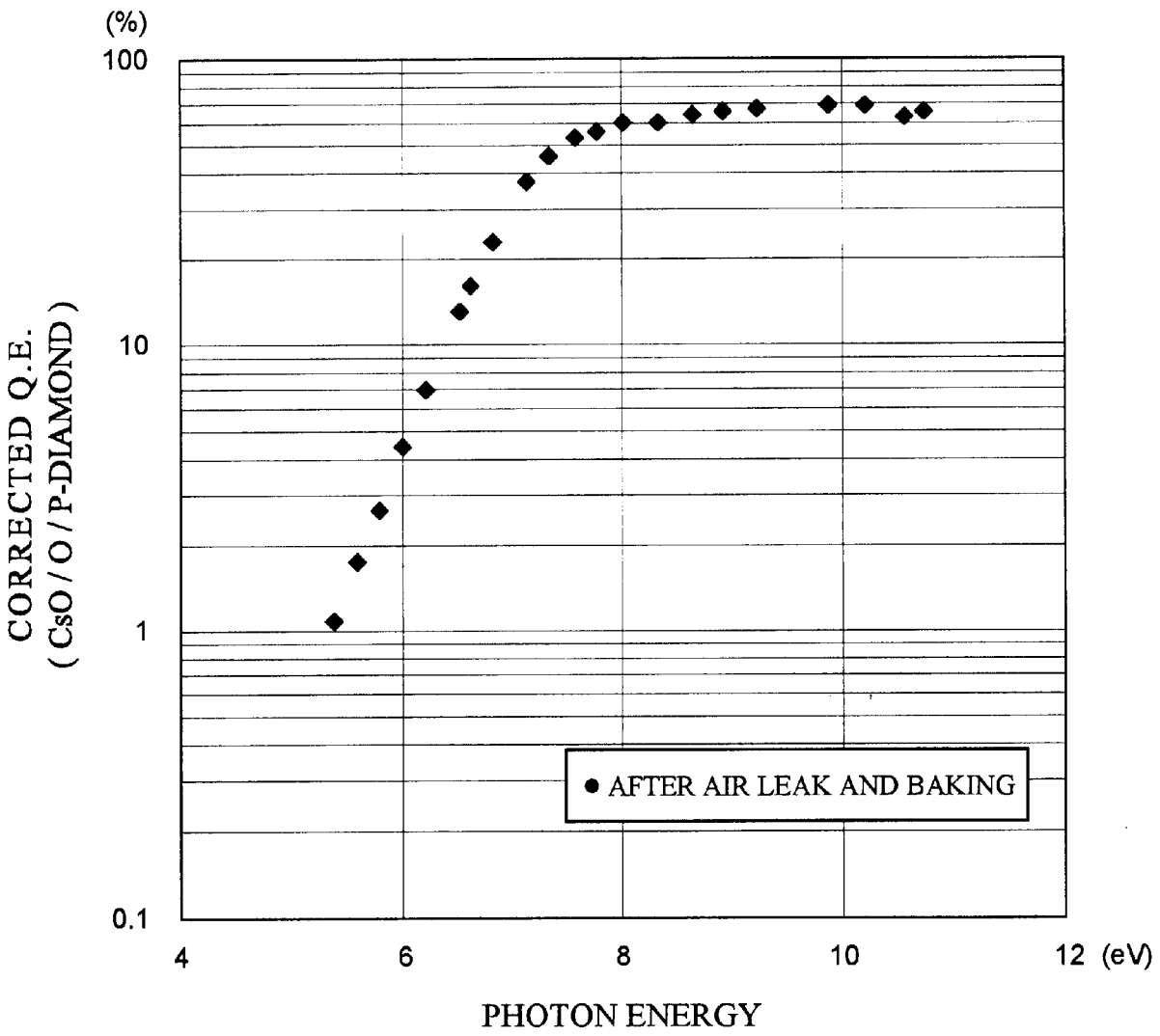
FIG. 23 is a (second) graph showing a spectral sensitivity characteristic of the electron tube equipped with the third example (CsO/O/p-Diamond) of the reflection type photocathode according to the present invention, whose abscissa and ordinate respectively indicate the photon energy (eV) and the quantum efficiency Q.E. (%) of the photocathode itself corrected on the basis of the transmittance of its entrance faceplate with respect to light to be detected, in which plotted are respective cases after baking.

FIG. 22 is a graph showing, for comparison, spectral sensitivity characteristics of the electron tube incorporating therein a fourth example (CsO/O/p-Diamond photocathode) of the reflection type photocathode according to the present invention before and after air leak. In this graph, the ordinate indicates the actually-measured quantum efficiency Q.E. (%). FIG. 23 is a graph in which the measured quantum efficiency Q.E. shown in FIG. 22 is plotted as the value (quantum efficiency Q.E.) corrected on the basis of the transmittance of the $MgF_2$ entrance faceplate.

As can be seen from these graphs, also in the case of the O-terminated polycrystalline diamond thin film, a considerably high sensitivity of 26% at the maximum was obtained when activated with Cs (the CsO active layer was formed). Though it is lower than the quantum efficiency of 49.5% obtained when terminated with hydrogen, it approximates 40% when corrected with the transmissivity of the $MgF_2$ entrance faceplate, and can be regarded as a considerably high level (quantum efficiency Q.E).

In addition, even after being baked at 200° C. after the air leak, the above-mentioned CsO/O/p-Diamond photocathode has the quantum efficiency Q.E. substantially identical to that before the air leak. It is higher than the recovery of about 60% obtained in the hydrogen-terminated sample. As a result, in both of the hydrogen-terminated photocathode and oxygen-terminated photocathode, when baked at 200° C. after being taken out into the air, a substantially identical quantum efficiency of 25% to 35% (corresponding to the corrected quantum efficiency of about 60% as can be seen from FIG. 23) is obtained.

In order to further evaluate the stability in detail, it is necessary to elaborately study processing conditions, for example, to evaluate the drift characteristic of the photocathode with reference to the air exposure time as a parameter. At any rate, it has been found that the polycrystalline diamond photocathode according to the present invention is considerably different in characteristics from the conventional alkali photocathodes and NEA photocathodes such as those made of GaAs, and is chemically stable. Conventionally, external photoelectric effect devices such as photocathode have been intrinsically disadvantageous in that, since they are quite sensitive to their surface state, their characteristics are likely to change under the influence of a trace amount of gas or ions. By contrast, according to conditions, diamond materials are considered to be quite insensitive to their surface state. Accordingly, there is a possibility that the present invention might achieve a breakthrough in the chemical stability of the external photoelectric effect devices that has conventionally been a drawback thereof as compared with the internal photoelectric effect devices.

As explained in the foregoing, it has been found that, even when baked at 200° C. for 4 hours after once exposed to the air, the Cs/O/p-Diamond photocathode can attain a sensitivity which is nearly 100% of that before baking. It indicates that the Cs/O/p-Diamond photocathode is quite stable, thus suggesting a possibility of achieving a breakthrough in the chemical stability of the external photoelectric effect devices that has conventionally been a drawback thereof.

Though the foregoing experiments were conducted for the reflection type photocathode, a similar sensitivity can also be obtained in the transmission type photocathode.

Figure 24:
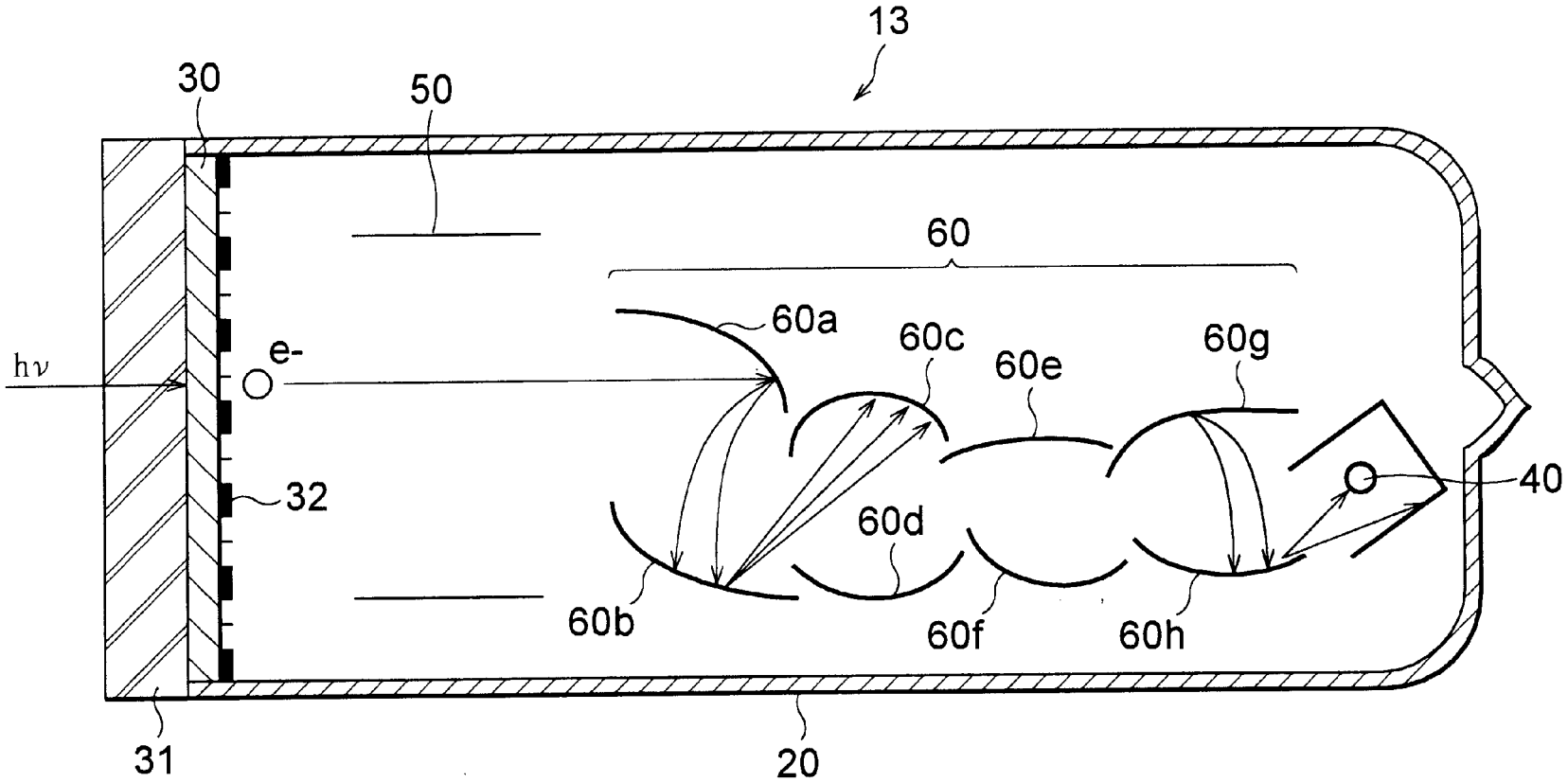
FIG. 24 is a sectional view showing a head-on type photomultiplier (electron tube) employing the transmission type photocathode according to the present invention.

In the following, a so-called line focus type photomultiplier (head-on type photomultiplier) equipped with the transmission type photocathode according to the present invention will be explained. FIG. 24 is a sectional view showing a configuration of an electron tube equipped with the transmission type photocathode according to the present invention. In the photomultiplier 13 shown in this drawing, the entrance faceplate 31 whose inner face is provided with the transmission type photocathode 30 (hydrogen-terminated polycrystalline diamond thin film) is supported by one end portion of the housing constituting the main body of the vacuum container 20, whereas light to be detected (hv) is made incident thereon along the direction indicated by depicted arrow. The other end portion of the housing is hermetically sealed with glass. Enclosed within the vacuum container 20 is the above-mentioned predetermined pressure of hydrogen.

Disposed at the other end portion within the vacuum container 20 is the anode 40. Disposed so as to be nearer to the transmission type photocathode 30 than to the anode 40 are a pair of focusing electrodes 50 for converging photoelectrons. Disposed near the anode 40 is an electron multiplying section 60 comprising a plurality of stages of dynodes 60*a* to 60*h* for successively multiplying photoelectrons emitted from the transmission type photocathode 30. Though not depicted, by way of a bleeder circuit and electric leads, bleeder voltages which are positive with respect to the transmission type photocathode 30 are applied to the transmission type photocathode 30, the focusing electrode 50, the electron multiplying section 60, and the anode 40 while being distributed so as to increase step by step toward the anode 40. For example, while a positive voltage on the order of several hundred V with respect to the transmission type photocathode 30 is applied to the first-stage dynode 60*a*, positive voltages are applied to the respective dynodes 60*a* to 60*h* in the electron multiplying section 60 such that they increase in increments of about 100 V toward the anode 40.

When light to be detected, which is ultraviolet light having a wavelength of 200 nm or shorter, is incident on thus constituted photomultiplier 13, photoelectrons ($e^-$) are emitted from the transmission type photocathode 30 in a greater number than those in the case of the conventional transmission type photocathode. Thus emitted photoelectrons are converged by the focusing electrodes 50, and are made incident on the first-stage dynode 60*a* while being accelerated. The first-stage dynode 60*a* emits secondary electrons in a number several times that of the incident photoelectrons. Thus emitted secondary electrons are subsequently made incident on the second-stage dynode 60*b* while being accelerated. As with the first-stage dynode 60*a*, the second-stage dynode 60*b* emits secondary electrons. The electron multiplying section 60 repeats, about 10 times, the multiplying operation for secondary electrons, whereby the photoelectrons emitted from the transmission type photocathode 30 finally become a secondary electron group multiplied on the order of $1\times10^6$ times. The secondary electron group emitted from the final-stage dynode 60*h* is collected at the anode 40 so as to be taken out as an output signal current.

In general, while a photomultiplier is equipped with an electron multiplying section as electron multiplying means, sufficient effects may not be obtained when combined with a transmission type photocathode having a low quantum efficiency Q.E. Namely, in such a photomultiplier, only a small number of photoelectrons can be emitted from the transmission type photocathode in response to weak light, whereby a photoelectron signal which has initially generated a counting miss cannot be multiplied at the electron multiplying section, thus lowering the efficiency in detection.

In the photomultiplier 13 equipped with the transmission type photocathode according to the present invention, a greater number of photoelectrons are emitted even in the case where the transmission type photocathode 30 receives the same weak light. Accordingly, in its photon counting mode, even when a counting miss of a photoelectron signal occurs, the influence of the uncounted photoelectron signal is substantially canceled by excellent multiplying functions of dynodes.

Though a photomultiplier using dynodes as electron multiplying means is shown in the above-mentioned electron tube, the electron multiplying means should not be restricted thereto. For example, similar effects can also be obtained in a microchannel plate (hereinafter referred to as MCP) constituted by a number of glass hole, each having a diameter of about 10 $\mu$m bundled together so that a two-dimensional array of electrons can be multiplied into secondary electrons, an electron implantation type diode, and the like. Also, without being restricted to the above-mentioned line focus type (head-on type), the photomultiplier may be a circular cage type (side-on type) using a reflection type photocathode, for example.

Figure 25:
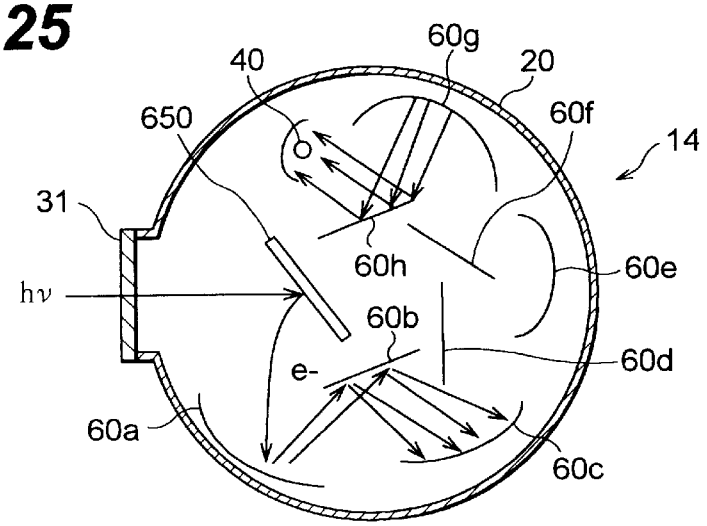
FIG. 25 is a sectional view showing a configuration of a side-on type photomultiplier (electron tube) employing the reflection type photocathode according to the present invention.

For example, FIG. 25 is a sectional view showing a configuration of a side-on type photomultiplier equipped with the reflection type photocathode according to the present invention. This side-on type photomultiplier 14 has a basic configuration similar to that of the head-on type photomultiplier 13 shown in FIG. 24. In the side-on type photomultiplier 14, however, its reflection type photocathode 650 is disposed so as to be inclined with respect to the direction of incidence of light to be detected, whereby photoelectrons are emitted from the surface on which the light to be detected is incident. Thus emitted photoelectrons are multiplied by the respective stages of dynodes 60*a* to 60*i* successively disposed along the side wall of the vacuum container 20, and the resulting secondary electron group is collected by the anode 40.

The electron tube to which the photocathode (encompassing both transmission and reflection types) should not be restricted to devices which simply detect weak light. For example, the electron tube shown in FIG. 26 is a so-called image intensifier tube which can detect a weak two-dimensional optical image as well.

In this image intensifier tube 15, unlike the above-mentioned photomultipliers 13 and 14, the transmission type photocathode 30 is supported, by way of In metal, by the upper end portion of the housing constituting the main body of the vacuum container 20. In place of the dynodes, an MCP 61 is placed at the middle portion of the housing of the vacuum container 20. A positive voltage of several hundred V with respect to the transmission type photocathode 30 is adapted to be applied to the MCP 61. The electric leads 50*a* and 50*b* respectively extend from the upper face side (hereinafter referred to as "input side") and the lower face side (hereinafter referred to as "output side") of the MCP 61 so as to penetrate through the side wall of the housing. Between the input and output sides of the MCP 61, a voltage for multiplication is applied by way of the electric leads 50*a* and 50*b*. Supported by the lower end portion of the housing of the vacuum container 20 is a fiber plate 41, whereas placed on the inner face thereof is a phosphor 42 (fluorescent film) to which a positive voltage of several kV with respect to the MCP 61 is applicable.

In order to make such image intensifier tube 15, the transmission type photocathode 30, the housing of the vacuum container 20 provided with the MCP 61, and the fiber plate 41 supporting the phosphor 42 are placed within an ultrahigh vacuum chamber (not depicted), and the latter is evacuated to a vacuum on the order of $1\times10^{-10}$ torr. Then, hydrogen at a pressure of about $1\times10^{-3}$ torr is introduced into the chamber, and the transmission type photocathode 30 is heated to about 300° C. As a result, its surface is terminated with hydrogen. Here, hydrogen may be evacuated from the chamber, and then a Cs active layer may further be formed on thus hydrogen-terminated transmission type photocathode 30 (polycrystalline diamond thin film) by the above-mentioned method of manufacture. Subsequently, after the fiber plate 41 is attached to one end of the housing 20, hydrogen at a pressure of about $1\times10^{-5}$ torr is introduced into the vacuum container 20. Then, after the transmission type photocathode 30 is supported by the other end of the housing by way of In metal, the transmission type photocathode 30 is pressure-deformed so as to be attached thereto, whereby the hermetically-sealed image intensifier tube 15 is obtained.

Figure 26:
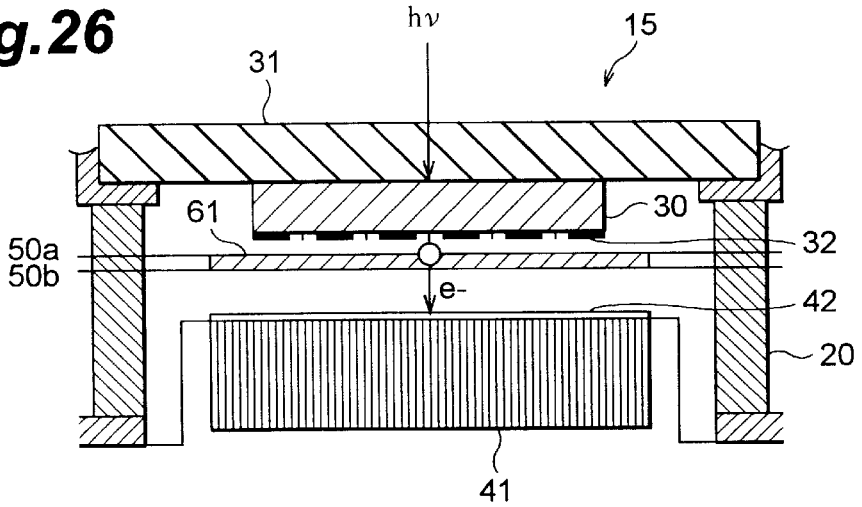
FIG. 26 is a sectional view showing a configuration of an image intensifier tube (electron tube) employing a fluorescent film.

In the case where a two-dimensional optical image, as light to be detected, is incident on the image intensifier tube 15 as shown in FIG. 26, a photoelectron ($e^-$) corresponding to the incident light is emitted from the transmission type photocathode 30 into the inner space (vacuum) of the vacuum container 20. Thereafter, thus emitted photoelectron is accelerated and made incident on the input side of the MCP 61, thereby being multiplied by the MCP 61 on the order of $1\times10^6$ times as secondary electrons. The two-dimensional electron image obtained by such secondary electron multiplication is emitted from the position on the output side corresponding to the incident position on the input side. When the individual secondary electrons constituting this two-dimensional electron image are accelerated and made incident on the phosphor 42, a two-dimensional image corresponding to the two-dimensional electron image is emitted and displayed as being intensified. Thus displayed two-dimensional image is taken out through the fiber plate 41 supporting the phosphor 42 to the outside so as to be observed.

Since the photocathode according to the present invention is used, this embodiment is not only effective in detecting weak light but also very effective in detecting the position of weak light.

Though the MCP 61 is used as the multiplying means in the image intensifier tube 15 shown in FIG. 26, without being restricted thereto, an electron implantation type diode may be used, for example. Also, in order to detect a two-dimensional optical image, an imaging tube having a CCD (solid-state imaging device) or the like may be used in place of the image intensifier tube employing the phosphor 42.

Figure 27:
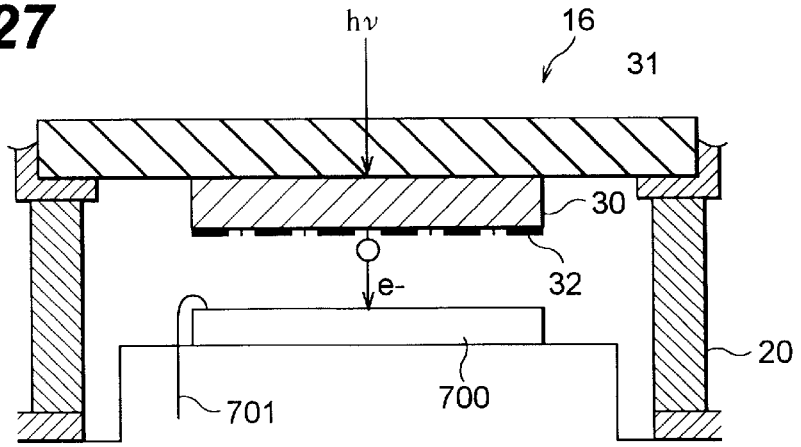
FIG. 27 is a sectional view showing a configuration of an imaging tube (electron tube) employing a solid-state imaging device.

FIG. 27 is a sectional view showing an imaging tube 16 comprising a CCD (solid-state imaging device) 700 in place of the phosphor 42. In this imaging tube 16, electric signals from the CCD 700 are taken out through a lead pin 701. When the CCD 700 is thus utilized, photoelectrons forming a two-dimensional electron image corresponding to the two-dimensional optical image formed by light to be detected which is incident on the photocathode are received by the respective pixels of the CCD 700, whereby electric signals corresponding to the two-dimensional optical image are outputted in time series through the lead pin 701.

The photocathode according to the present invention is applicable not only to the above-mentioned photomultiplier, image intensifier tube, and imaging tube, but also to other light detecting apparatus such as streak tube.

In accordance with the present invention, as explained in the foregoing, since a transmission type photocathode or reflection type photocathode is constituted by polycrystalline diamond or a material mainly composed of polycrystalline diamond, a photocathode exhibiting a higher quantum efficiency than that of the conventional photocathodes can be realized at a lower cost. Also, in the photocathode according to the present invention, since the work function is further lowered at the surface of the diamond thin film that is appropriately processed by termination with hydrogen or oxygen and further by an active layer made of an alkali metal or its compound which is formed thereon, a further higher quantum efficiency can be obtained.

In addition, when such transmission and reflection type photocathodes are applied to electron tubes such as photomultiplier, image intensifier tube, imaging tube, and the like, devices which are quite effective in measuring weak light can be realized.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 244976/1996 filed on Sep. 17, 1996 is hereby incorporated by reference.

What is claimed is:

1. An electron tube comprising:

an entrance faceplate transparent to the incident light having a predetermined wavelength;

a photocathode, for emitting photoelectrons excited from a valence band to a conduction band by incident light having a predetermined wavelength, provided on and in direct contact with said entrance faceplate, said photocathode having a first surface which the incident light reaches, and a second surface opposing said first surface and emitting the photoelectrons, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectrons from said photocathode are emitted within said container;

an anode, accommodated in said container, for directly or indirectly collecting the photoelectrons emitted from said photocathode; and a conductive member being electrically connected to said anode, wherein said entrance faceplate is mainly composed of magnesium fluoride (MgF2) which is at least transparent to ultraviolet light having a wavelength not longer than 200 nm.

2. An electron tube according to claim 1, wherein at least one surface of said first layer in said photocathode is terminated with oxygen.

3. An electron tube according to claim 1, wherein said photocathode further comprises a second layer provided on at least one surface of said first layer, said second layer comprising an alkali metal or a compound thereof.

4. An electron tube according to claim 1, wherein said first layer in said photocathode is of p-type conduction.

5. An electron tube comprising:

an entrance faceplate transparent to the incident light having a predetermined wavelength;

a photocathode, for emitting photoelectrons excited from a valence band to a conduction band by incident light having a predetermined wavelength, provided on and in direct contact with said entrance faceplate, said photocathode having a first surface which the incident light reaches, and a second surface opposing said first surface and emitting the photoelectrons, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectrons from said photocathode are emitted within said container;

an anode, accommodated in said container, for directly or indirectly collecting the photoelectrons emitted from said photocathode;

a conductive member being electrically connected to said anode; and an electron multiplying section which is accommodated in said container and guides secondary electrons to said anode, said secondary electron being obtained while said electron multiplying section multiplies, in a cascade manner, the photoelectrons emitted from said photocathode.

6. An electron tube comprising:

an entrance faceplate transparent to the incident light having a predetermined wavelengh;

a photocathode, for emitting photoelectrons excited from a valence band to a conduction band by incident light having a predetermined wavelength, provided on and in direct contact with said entrance faceplate, said photocathode having a first surface which the incident light reaches, and a second surface opposing said first surface and emitting the photoelectrons, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectrons from said photocathode are emitted within said container;

an anode, accommodated in said container, for directly or indirectly collecting the photoelectrons emitted from said photocathode; and a conductive member being electrically connected to said anode, wherein said anode is a fluorescent film which emits light when receiving the photoelectrons emitted from said photocathode in response to said incident light, so as to form a two-dimensional electron image corresponding to a two-dimensional optical image of said incident light.

7. An electron tube comprising:

an entrance faceplate transparent to the incident light having a predetermined wavelength;

a photocathode, for emitting photoelectrons excited from a valence band to a conduction band by incident light having a predetermined wavelength, provided on and in direct contact with said entrance faceplate, said photocathode having a first surface which the incident light reaches, and a second surface opposing said first surface and emitting the photoelectrons, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectrons from said photocathode are emitted within said container;

an anode, accommodated in said container, for directly or indirectly collecting the photoelectrons emitted from said photocathode; and a conductive member being electrically connected to said anode, wherein said anode is a solid-state imaging device which receives the photoelectrons emitted from said photocathode in response to said incident light and outputs an electric signal corresponding to a two-dimensional optical image of said incident light.

8. An electron tube comprising:

an entrance faceplate transparent to incident light having a predetermined wavelength;

a photocathode, for emitting a photoelectron excited from a valence band to a conduction band by the incident light having a predetermined wavelength, said phocathode having a first surface which the incident light reaches, and a second surface opposing said first surface and emitting the photoelectron, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectron from said photocathode is emitted within said container; and an anode, accommodated in said container, for directly or indirectly collecting the photoelectron emitted from said photocathode;

wherein hydrogen is enclosed within said container at a partial pressure within a range of $1\times10^{-6}$ to $1\times10^{-3}$ torr.

9. An electron tube comprising:

an entrance faceplate transparent to the incident light having a predetermined wavelength;

a photocathode, for emitting photoelectrons excited from a valence band to a conduction band by incident light having a predetermined wavelength, provided on and in direct contact with said entrance faceplate, said photocathode having a first surface which the incident light reaches, and a second surface opposing said first surface and emitting the photoelectrons, wherein said photocathode comprises a first layer being made of polycrystalline diamond or a material mainly composed of polycrystalline diamond;

a container accommodating said photocathode and supporting said entrance faceplate, whereby the incident light reaches said photocathode through said entrance faceplate and the photoelectrons from said photocathode are emitted within said container;

an anode, accommodated in said container, for directly or indirectly collecting the photoelectrons emitted from said photocathode; and a conductive member being electrically connected to said anode, wherein at least one surface of said first layer in said photocathode is terminated with hydrogen.

10. An electron tube comprising:

an entrance faceplate transparent to incident light having a predetermined wavelength;

a photocathode, for emitting a photoelectron excited from a valence band to a conduction band by the incident light having a predetermined wavelength, said photocathode having a first layer being made of polycrystalline diamond or a material mainly composed of polycrystalline diamond;

a container accommodating said photocathode and supporting said entrance faceplate; and an anode, accommodated in said container, for directly or indirectly collecting the photoelectron emitted from said photocathode;

wherein hydrogen is enclosed within said container at a partial pressure within a range of $1\times10^{-6}$ to $1\times10^{-3}$ torr.

* * * * *